US008190316B2

(12) United States Patent
Kaji

(10) Patent No.: US 8,190,316 B2
(45) Date of Patent: May 29, 2012

(54) CONTROL APPARATUS FOR MARINE VESSEL PROPULSION SYSTEM, AND MARINE VESSEL RUNNING SUPPORTING SYSTEM AND MARINE VESSEL USING THE SAME

(75) Inventor: Hirotaka Kaji, Shizuoka (JP)

(73) Assignee: Yamaha Hatsudoki Kabushiki Kaisha, Shizuoka (JP)

( * ) Notice: Subject to any disclaimer, the term of this patent is extended or adjusted under 35 U.S.C. 154(b) by 1102 days.

(21) Appl. No.: 11/868,067

(22) Filed: Oct. 5, 2007

(65) Prior Publication Data

US 2008/0254689 A1 Oct. 16, 2008

(30) Foreign Application Priority Data

Oct. 6, 2006 (JP) ..... 2006-275108

(51) Int. Cl.
*B60L 15/00* (2006.01)

(52) U.S. Cl. ..... 701/21; 318/588; 440/84

(58) Field of Classification Search ..... 701/21, 701/41, 42, 70, 72; 440/1, 2
See application file for complete search history.

(56) References Cited

U.S. PATENT DOCUMENTS 3,280,781 A * 10/1966 Koerner ..... 114/144 R
4,220,111 A * 9/1980 Krautkremer et al. ..... 440/53
4,767,363 A * 8/1988 Uchida et al. ..... 440/1
5,931,110 A 8/1999 Yamamoto
6,073,721 A * 6/2000 Grabowski ..... 180/422
6,311,634 B1 * 11/2001 Ford et al. ..... 114/144 R
6,336,833 B1 * 1/2002 Rheault et al. ..... 440/1
6,428,371 B1 * 8/2002 Michel et al. ..... 440/38
6,799,528 B1 * 10/2004 Bekker ..... 114/151
6,994,046 B2 * 2/2006 Kaji et al. ..... 114/144 R
6,995,527 B2 * 2/2006 DePasqua ..... 318/16
6,997,763 B2 * 2/2006 Kaji ..... 440/1
7,166,003 B2 * 1/2007 Motose ..... 440/1
7,174,842 B1 * 2/2007 Lin ..... 114/151
7,429,202 B2 * 9/2008 Yazaki et al. ..... 440/53
7,452,250 B2 * 11/2008 Yazaki et al. ..... 440/2
2002/0127926 A1 * 9/2002 Michel et al. ..... 440/38
2003/0066469 A1 * 4/2003 Matsuda et al. ..... 114/144 R
2003/0145826 A1 * 8/2003 Umemoto et al. ..... 123/350
2003/0191562 A1 * 10/2003 Robertson et al. ..... 701/21
2004/0014373 A1 * 1/2004 McKenney et al. ..... 440/40
2004/0090195 A1 * 5/2004 Motsenbocker ..... 318/109
2004/0227484 A1 * 11/2004 DePasqua ..... 318/588
2005/0021203 A1 * 1/2005 Iwazaki et al. ..... 701/36
2005/0080522 A1 * 4/2005 Hamamatsu et al. ..... 701/21
2005/0085141 A1 * 4/2005 Motose ..... 440/87

(Continued)

FOREIGN PATENT DOCUMENTS

JP 02-227395 A 9/1990

(Continued)

*Primary Examiner* — Thomas G. Black
*Assistant Examiner* — Sze-Hon Kong
(74) *Attorney, Agent, or Firm* — Keating & Bennett, LLP

(57) ABSTRACT

A control apparatus controls a marine vessel propulsion system which is equipped with a propeller system to generate a propulsive force and a steering mechanism to determine a steering angle of the propeller system. The control apparatus includes a target propulsive force setting unit arranged to set a target propulsive force, and a propeller system control unit arranged to control an output of the propeller system such that the output is lower than the target propulsive force while the steering angle is being changed.

14 Claims, 15 Drawing Sheets

U.S. PATENT DOCUMENTS

| | | | | |
|---|---|---|---|---|
| 2005/0092225 | A1* | 5/2005 | Kaji et al. | 114/144 R |
| 2005/0164569 | A1* | 7/2005 | Kaji et al. | 440/1 |
| 2005/0199169 | A1* | 9/2005 | Mizutani | 114/144 RE |
| 2005/0241556 | A1* | 11/2005 | Takada et al. | 114/144 E |
| 2005/0263058 | A1* | 12/2005 | Suemori et al. | 114/144 R |
| 2006/0009095 | A1* | 1/2006 | Uraki et al. | 440/47 |
| 2010/0121505 | A1 | 5/2010 | Yamazaki et al. | |
| 2010/0198441 | A1* | 8/2010 | Mizuno et al. | 701/22 |
| 2011/0137499 | A1* | 6/2011 | Sakaguchi et al. | 701/21 |

FOREIGN PATENT DOCUMENTS

| | | | | |
|---|---|---|---|---|
| JP | 10-59291 | A | | 3/1998 |
| JP | 2002-234495 | A | | 8/2002 |
| JP | 2006160214 | | * | 6/2006 |
| WO | 2007/010767 | A1 | | 1/2007 |

* cited by examiner

FIG. 13A WITHOUT SCHEDULING CONTROL
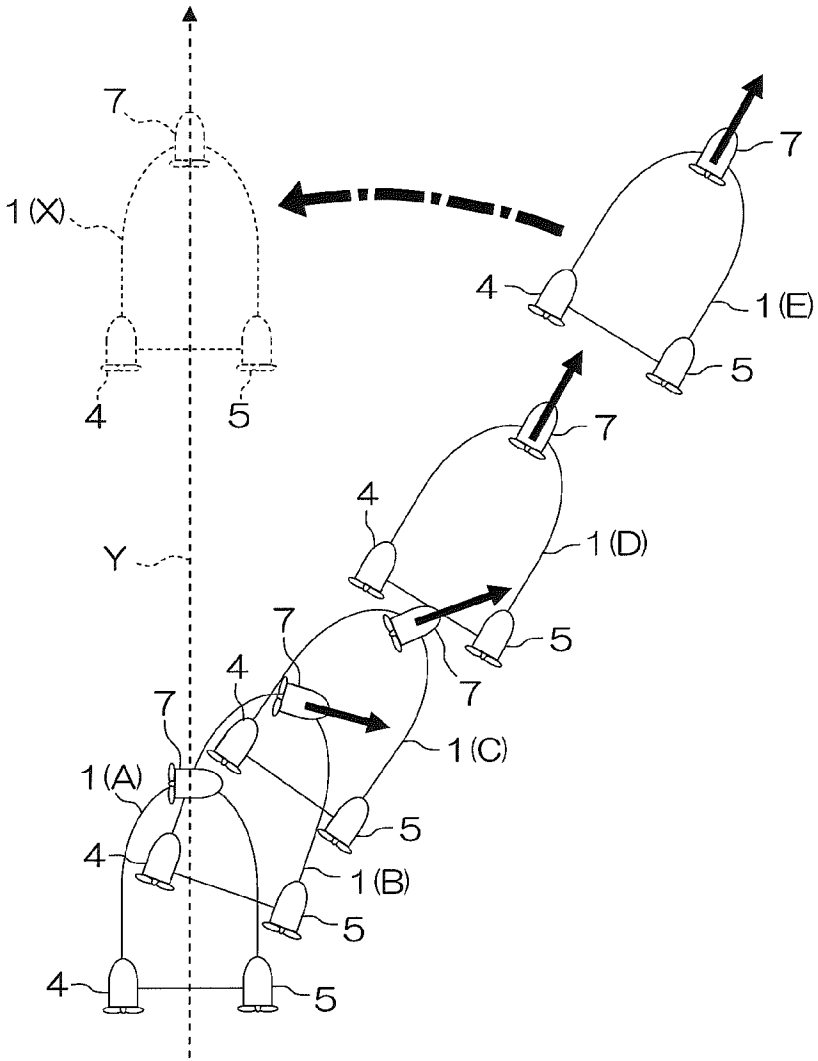
FIG. 13B WITH SCHEDULING CONTROL
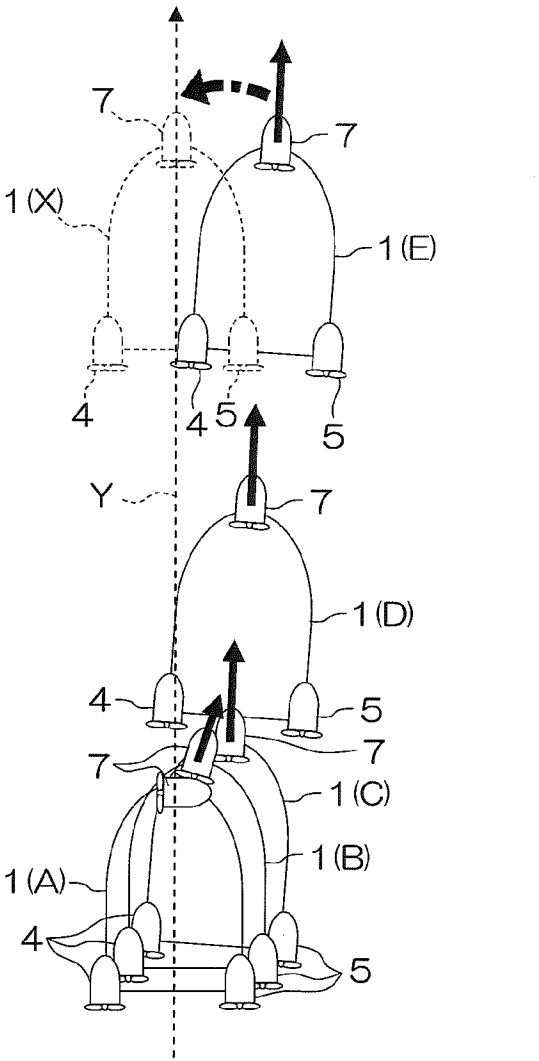

CONTROL APPARATUS FOR MARINE VESSEL PROPULSION SYSTEM, AND MARINE VESSEL RUNNING SUPPORTING SYSTEM AND MARINE VESSEL USING THE SAME

BACKGROUND OF THE INVENTION

1. Field of the Invention

The present invention relates to a control apparatus for controlling a marine vessel propulsion system equipped with a steering mechanism and a propeller system, and a marine vessel running supporting system and a marine vessel equipped with such a control apparatus.

2. Description of Related Art

There is an electromotive outboard motor that is one type of marine vessel propulsion system to provide a propulsive force to a marine vessel. The electromotive outboard motor is mainly used in places where the use of an engine type outboard motor is prohibited in view of environmental protection, such as in a lake.

The electromotive outboard motor includes a propeller system having an electric motor and a propeller coupled with the drive shaft of the electric motor, wherein, by controlling the rotational speed of the electric motor, it is possible to control a propulsive force generated by the propeller system, and by controlling the direction (steering angle) of the propulsive force generated by the propeller system, it is possible to control the advancing direction of a marine vessel.

An electromotive outboard motor disclosed in U.S. Pat. No. 5,931,110 is mainly used for short-distance movements and adjustment of the stem direction in a small-sized fishing boat, for example, a bass fishing boat. Further, in U.S. Pat. No. 5,931,110, a so-called auto pilot function is disclosed. The auto pilot automatically controls the steering angle and the rotational speed of an electric motor such that a vessel keeps a position in which the stem is oriented in a fixed direction at all times.

In the following description, not only in an electromotive outboard motor but also a general outboard motor, a motor (including an electric motor and an engine) and a propeller (propulsive force generation member) are collectively called a "propeller system". Also, a mechanism for controlling the direction (steering angle) of a propulsive force generated by the propeller system is called a "steering mechanism". In the steering mechanism, an electric motor and other electromotive power source which are driven by electric energy, and hydraulic equipment may generate power to change the steering angle. In addition, there is a case where a portion of a drive force generated by a motor may be used to change the steering angle. The propeller system and the steering mechanism are collectively called a "marine vessel propulsion system". It is common that the outboard motor is additionally provided with a steering mechanism in addition to the propeller system. Such an outboard motor is included in the definition of the above-mentioned marine vessel propulsion system.

In a marine vessel maneuvering mechanism disclosed in Japanese Unexamined Patent Publication No. 02-227395, the steering angles of respective propeller systems are controlled by expanding and contracting a cylinder rod which intervenes between two propeller systems, via an electric pump driven by a control motor.

Since a motor whose output is smaller than the propeller system is usually used as a motor of the steering mechanism, the steering mechanism generally includes a reduction mechanism that reduces a drive force generated by the motor and transmits the reduced drive force. Therefore, the time required to reach a target steering angle becomes comparatively long. In particular, as the propeller system becomes large in size, a reduction mechanism whose reduction ratio is correspondingly large is used. Therefore, the time to reach a target steering angle is increased.

On the other hand, since a propeller system rotates a propeller directly by an electric motor or an engine, or rotates the propeller after being reduced at a small reduction ratio, a target propulsive force can quickly be reached. Accordingly, where respective controls of a propeller system and a steering mechanism are simultaneously started based on respective target values, the propulsive force will reach the target value earlier than the steering angle reaches the target value. In this case, since a propulsive force is generated in the hull in a direction not intended by an operator for the period from immediately after the time when the steering angle begins changing to the time when the target value is reached, there is a possibility that a desired ship behavior cannot be achieved.

SUMMARY OF THE INVENTION

A preferred embodiment of the present invention provides a control apparatus for controlling a marine vessel propulsion system equipped with a propeller system to generate a propulsive force and a steering mechanism to change a steering angle of the propeller system. The control apparatus includes a target propulsive force setting unit arranged to set a target propulsive force and a propeller system control unit arranged to control an output of the propeller system such that the output is lower than the target propulsive force while the steering angle is being changed.

According to a preferred embodiment of the present invention, the output of the propeller system is controlled and suppressed (reduced) such that the output becomes lower than a target value while the steering angle is being changed. Therefore, it can be prevented that a propulsive force is applied to a hull in a direction not intended by an operator while the steering angle does not reach a target value, whereby a desired ship behavior can be realized. The output of the propeller system may be suppressed during the entire period of changing the steering angle or may be controlled only during a portion of the above period.

It is preferable that the control apparatus further includes a steering angle judging unit arranged to judge whether the steering angle reaches a predetermined threshold or not, and in response to the steering angle judging unit having judged that the steering angle has reached the threshold, the propeller system control unit sets the output of the propeller system such that the target propulsive force can be attained.

With this unique construction, since the output of the propeller system is set so as to attain a target propulsive force when the steering angle of the propeller system reaches a predetermined threshold, the timing when the propeller system generates a target propulsive force can be delayed with respect to the time of starting the control of the steering mechanism. For this reason, the propulsive force can be generated in a direction intended by an operator, whereby a desired ship behavior can be realized.

The control apparatus may control a plurality of marine vessel propulsion systems, and the steering angle judging unit may be arranged to judge whether the steering angles of all the marine vessel propulsion systems reach a predetermined threshold or not. In this case, it is preferable that, in response to the steering angle judging unit having judged that the steering angles of all of the plurality of marine vessel propulsion systems have reached the predetermined threshold, the propeller system control unit sets the outputs of the plurality of propeller systems such that the above-mentioned target propulsive force is attained.

According to the above-described unique construction, the outputs of the propeller systems are set so as to attain the target propulsive force when the steering angles of all the propeller systems respectively provided in the plurality of marine vessel propulsion systems have reached the predetermined threshold. Accordingly, the time when the propeller systems generate the target propulsive force can be delayed with respect to the control start timing of all the steering mechanisms. For this reason, it is possible to generate the propulsive force in a direction intended by an operator, whereby a desired ship behavior can be realized. A target propulsive force may be input by an operator or may be automatically set by the system in the case of autonomous navigation.

Preferably, the control apparatus controls the steering mechanism based on a target steering angle, and further includes a threshold setting unit arranged to determine the predetermined threshold by multiplying the target steering angle by a predetermined ratio.

With this unique construction, since the predetermined threshold is determined by multiplying the target steering angle by the predetermined ratio, the threshold can be determined suitably corresponding to the target steering angle. Therefore, it is possible to optimize, regardless of the target steering angle, the relationship between the time when the steering mechanism starts control and the time when the propeller system generates a target propulsive force.

It is preferable that the propeller system control unit includes a target propulsive force suppressing unit arranged to suppress the target propulsive force.

Accordingly, since the target propulsive force is suppressed by the target propulsive force suppressing unit, the propeller system control unit can securely control the output of the propeller system such that the output becomes smaller than the target propulsive force.

It is preferable that the propeller system control unit decreases a suppressed amount of the target propulsive force as the steering angle approaches the target steering angle.

Where the steering angle is near the target steering angle, since an unnecessary moment generated by the propeller system becomes small, the influence applied by the output of the propeller system to the ship behavior is not significant. Rather, since the output of the propeller system approaches the target propulsive force as the steering angle approaches the target steering angle, the ship behavior becomes fast, whereby maneuverability becomes excellent.

It is preferable that the control apparatus further includes a notification unit arranged to provide an indication that the output of the propeller system is being controlled such that the output is lower than the target propulsive force.

According to this unique construction, since it is possible for an operator to know that the output of the propeller system is being controlled such that the output becomes lower than the target propulsive force, the sense of discomfort of the operator can be reduced.

It is preferable that the marine vessel propulsion system includes at least a propeller system provided at a stem portion of a marine vessel. Herein, the stem portion in a marine vessel means a portion of approximately one-third of the longitudinal direction dimension of the marine vessel from the stem end.

Since the propeller system provided at the stem portion is generally small-sized, it is light in weight. On the other hand, a propeller system provided at the stern portion is generally large-sized. Therefore, the center of gravity of a hull is biased to the stern side due to the weight of the propeller system at the stern portion. Therefore, the distance from the propeller system provided at the stem portion to the center of gravity of the hull becomes comparatively long. Accordingly, the propulsive force of the propeller system provided at the stem portion applies to the hull a large moment around the center of gravity, and provides a large influence on the ship behavior.

Therefore, in one preferred embodiment according to the present invention, the output of the propeller system provided at the stem portion is controlled such that the output becomes lower than a target propulsive force while the steering angle is being changed. For this reason, an undesired moment can be suppressed and minimized, whereby a desired ship behavior can be realized.

The steering mechanism may include a reduction mechanism arranged to reduce power to change the steering angle. Generally, since great power is necessary in the steering mechanism although a large-sized power source cannot be used for the steering mechanism, a reduction mechanism is often used. In this case, by using the reduction mechanism, there is a possibility that it takes a comparatively long time until the steering angle reaches a target value. However, as described above, since the output of the propeller system is controlled such that the output becomes lower than a target propulsive force while the steering angle is being changed, a great propulsive force applied in a direction not intended by an operator can be prevented from being generated in a hull while the steering angle does not reach the target value.

A marine vessel running supporting system according to one preferred embodiment of the present invention includes a marine vessel propulsion system including a propeller system to generate a propulsive force and a steering mechanism to determine a steering angle of the propeller system, and a control apparatus for the marine vessel propulsion system. Also, a marine vessel according to one preferred embodiment of the present invention includes a hull, a marine vessel propulsion system which is attached to the hull and includes a propeller system to generate a propulsive force and a steering mechanism to determine a steering angle of the propeller system, and a control apparatus for the marine vessel propulsion system.

According to the above-described constructions, the output of the propeller system is controlled such that the output becomes lower than a target propulsive force while the steering angle is being changed. Therefore, it is possible to prevent a great propulsive force from being generated in a hull in a direction not intended by an operator while the steering angle does not reach a target value, whereby a desired ship behavior can be realized.

The marine vessel may be a comparatively small-sized vessel such as a cruiser, a fishing boat, a water jet, and a watercraft.

Further, a propulsion system for marine vessel may be any type of an outboard motor, an inboard/outboard motor (a stern drive), an inboard motor, or a water jet drive. The outboard motor has a propeller system including a motor (engine or electric motor) and a propulsive force generating member (that is, a propeller) outboard and it is provided with a steering mechanism, which turns the entire propeller system in the horizontal direction with respect to a hull. The inboard/outboard motor is one in which a motor is disposed inboard and a drive unit including a propulsive force generating member and a steering mechanism is disposed outboard. In the inboard motor, both a motor and a drive unit are provided in a hull, and a propeller shaft extends from the drive unit outboard. In this case, the steering mechanism is preferably separate from the motor and the drive unit. The water jet drive is one in which water sucked in through a hull bottom is accelerated via a pump and is jetted through a jet nozzle at the stern to obtain a propulsive force. In this case, the steering mechanism preferably includes the jet nozzle and a mechanism for pivoting the jet nozzle along the horizontal plane.

Other elements, features, steps, characteristics and advantages of the present invention will become more apparent from the following detailed description of the preferred embodiments with reference to the attached drawings.

BRIEF DESCRIPTION OF THE DRAWINGS

FIG. 7A and FIG. 7B are views to describe operation of a joystick, wherein FIG. 7A is a perspective view showing an inclined joystick, and FIG. 7B is a plan view attained by projecting the joystick, which is in the state shown in FIG. 7A), onto the hull coordinate plane (that is, x-y plane in the hull coordinate system).

FIG. 11A and FIG. 11B are views showing, in chronological order, how a steering angle and a propulsive force of an outboard motor reach the respective target values δ and F, wherein FIG. 11A shows a case where no scheduling control is carried out, and FIG. 11B shows a state where scheduling control is carried out, respectively.

FIG. 12A and FIG. 12B are image views showing, by vectors with a predetermined interval, the propulsive force generated until the steering angle reaches a target value in the stem outboard motor, wherein FIG. 12A shows a case where no scheduling control is carried out, and FIG. 12B shows a case where scheduling control is carried out, respectively.

FIG. 13A and FIG. 13B are image views showing a movement locus of a marine vessel until the steering angle reaches a target value in the stem outboard motor, wherein FIG. 13A shows a case where no scheduling control is carried out, and FIG. 13B shows a case where scheduling control is carried out, respectively.

FIG. 17A and FIG. 17B are image views showing, in a display section, a state of notifying whether scheduling control is carried out or not, wherein FIG. 17A shows a state of notifying that the scheduling control is in operation, and FIG. 17B shows a state where the scheduling control has finished, respectively.

DETAILED DESCRIPTION OF PREFERRED EMBODIMENTS

Figure 1:
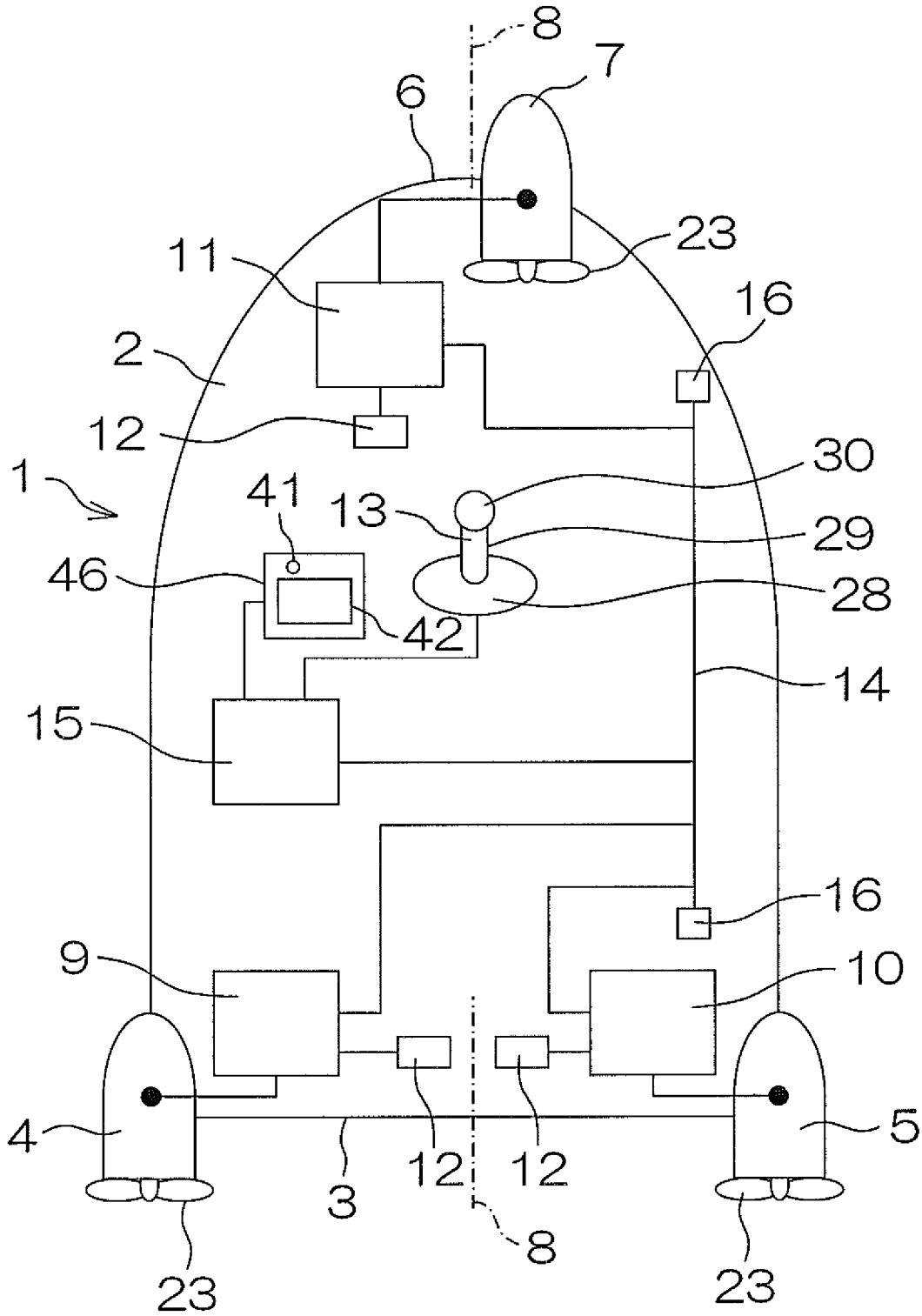
FIG. 1 is a conceptual view to describe a construction of a marine vessel according to one preferred embodiment of the invention.

FIG. 1 is a conceptual view to describe a construction of a marine vessel 1 according to one preferred embodiment of the present invention. The marine vessel 1 is a comparatively small-sized vessel such as a bass boat. The marine vessel 1 includes a hull 2, a pair of outboard motors 4 and 5 attached to a stern 3 of the hull 2, and an outboard motor 7 attached to the stem 6 thereof.

The pair of outboard motors 4 and 5 disposed on the stern 3 are attached at symmetrical positions with respect to a centerline 8 passing through the stern 3 and the stem 6. In detail, the outboard motor 4 is attached at the port-side rear portion of the hull 2, and the outboard motor 5 is attached at the starboard-side rear portion of the hull 2.

In addition, the outboard motor 7 disposed at the stem 6 is attached at a position displaced in either of the left and right directions (in the present preferred embodiment, displaced to the right side) from the centerline 8. As a matter of course, the outboard motor 7 at the stem 6 may be mounted on the centerline 8. However, since a fish detector and other devices are often attached at this position, it is preferable that the above displaced arrangement is selected.

The outboard motors 4, 5 and 7 function as marine vessel propulsion systems. Hereinafter, they are sometimes respectively called a "port-side outboard motor 4," a "starboard-side outboard motor 5" and a "stem outboard motor 7" in order to distinguish them.

The port-side outboard motor 4, the starboard-side outboard motor 5 and the stem outboard motor 7 are respectively provided with electronic control units (ECU) 9, 10 and 11 (hereinafter, in order to distinguish them, they may be called "port-side ECU 9," "starboard-side ECU 10," and "stem ECU 11," and may be called "outboard motor ECUs 9, 10, and 11" as a general term). Batteries 12 are connected to the port-side ECU 9, the starboard-side ECU 10 and the stem ECU 11, respectively, and electric power is supplied from the respective batteries 12 to the corresponding ECUs and outboard motors.

A joystick 13 is provided in the hull 2, as an operating member which is operated for steering. By operating the joystick 13, it is possible to control forward and rearward traveling of the marine vessel 1 and turning thereof to the left and right. Information pertaining to the operations of the joystick 13 is input into a marine vessel running controlling apparatus 15 via an inboard LAN 14 such as a CAN (Control Area Network) disposed in the hull 2.

A display section 46 functioning as a notification unit is provided in the hull 2 preferably in the vicinity of, for example, the joystick 13. The display section 46 is connected to the marine vessel running controlling apparatus 15 via the inboard LAN 14 or may be integrated with the marine vessel running controlling apparatus 15. The display section 46 preferably includes an indicator lamp 41 and a display screen 42. The display section 46 visually notifies an operator of whether scheduling control described later is carried out, by using the indicator lamp 41 and the display screen 42. The display section 46 may notify the operator by voice or by vibrations.

The marine vessel running controlling apparatus 15 preferably is an electric control unit (ECU) including a microcomputer, and functions as a control apparatus to control the outboard motors 4, 5 and 7 (marine vessel propulsion systems) and carries out control of the propulsive force and also carries out steering control. The marine vessel running controlling apparatus 15 further carries out communications with the port-side ECU 9, the starboard-side ECU 10 and the stem ECU 11 via the inboard LAN 14. In detail, the marine vessel running controlling apparatus 15 obtains actual values of the rotational speeds of motors 22 (refer to FIG. 3) provided in the respective outboard motors 4, 5 and 7 from the outboard motor ECUs 9, 10 and 11, and actual values of the steering angles expressing the directions of the respective outboard motors 4, 5 and 7 from the outboard motor ECUs 9, 10 and 11. On the other hand, the marine vessel running controlling apparatus 15 is designed so as to provide the outboard motor ECUs 9, 10 and 11 target values of propulsive forces to be generated by the respective outboard motors 4, 5 and 7 and target values of the steering angles of the respective outboard motors 4, 5 and 7. A reference numeral 16 denotes a termination device.

Figure 2:
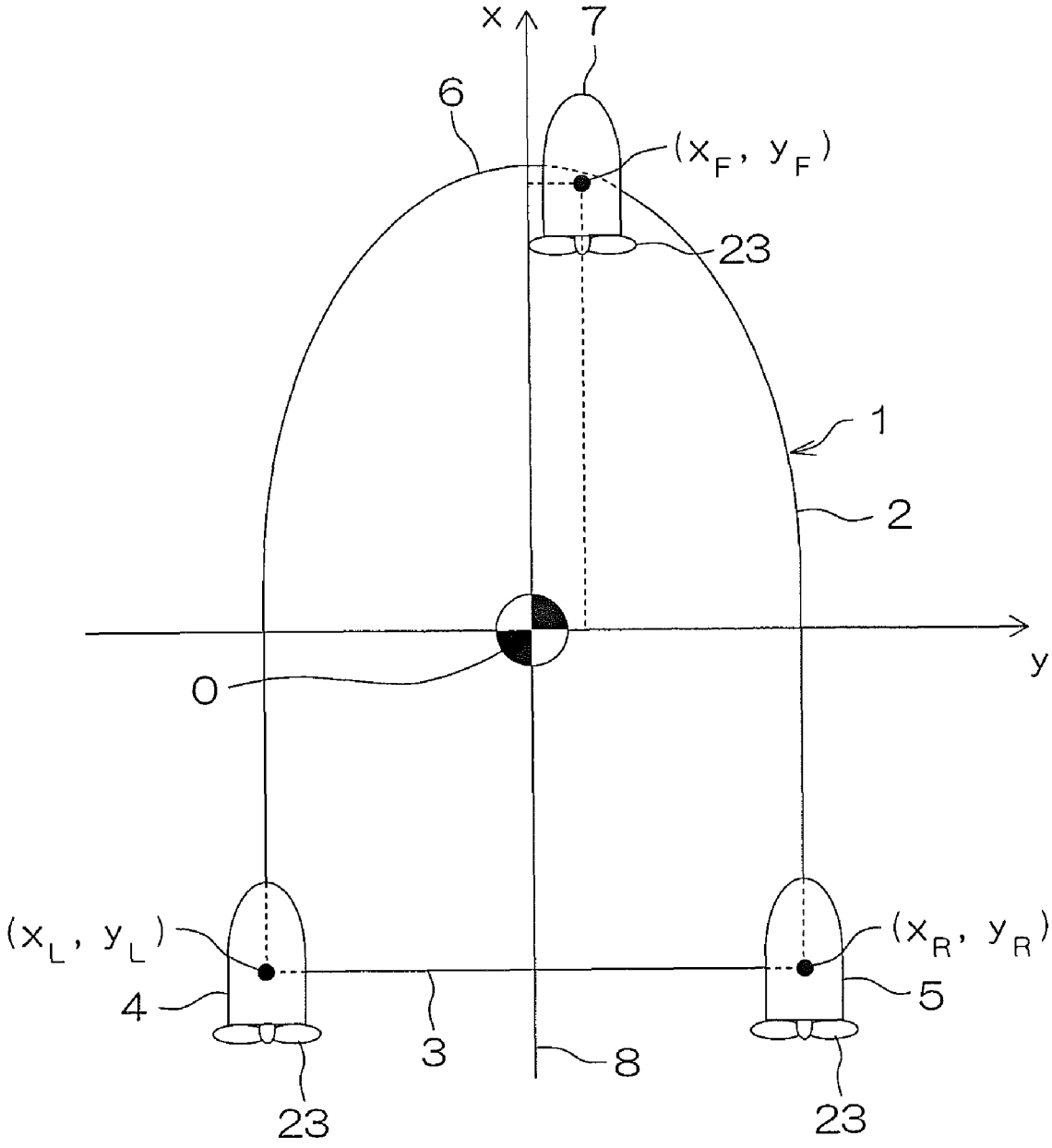
FIG. 2 is a view showing the coordinate positions of a port-side outboard motor, a starboard-side outboard motor and a stem outboard motor in a coordinate system (hull coordinate system) defined based on a hull.

FIG. 2 shows coordinate positions of the port-side outboard motor 4, the starboard-side outboard motor 5 and the stem outboard motor 7 in a coordinate system (hull coordinate system) defined based on the hull 2. The hull coordinate system is a two-dimensional orthogonal coordinate system defined in a plane parallel to the water surface where the marine vessel 1 is positioned. In further detail, the hull coordinate system is defined by an x-axis equal to the centerline 8 of the hull 2 and parallel to the front and rear direction of the hull 2, and a y-axis orthogonal to the x-axis and parallel to the left and right direction of the hull 2. A coordinate origin O is adopted at an instantaneous rotational center of the hull 2 at turning.

The instantaneous rotational center may be an instantaneous rotational center in design, which is determined corresponding to the types of the hull 2 and the outboard motors 4, 5 and 7. Also, by performing test running, the instantaneous rotational center may be measured in advance.

In the above-mentioned hull coordinate system, the x and y coordinates of the respective outboard motors 4, 5 and 7 are given by the following expressions (1), $$\text{Coordinates } (x,y) \text{ of the port-side outboard motor } 4=(xL,yL) \quad (1)$$

$$\text{Coordinates } (x,y) \text{ of the starboard-side outboard motor } 5=(xR,yR) \quad (1)$$

$$\text{Coordinates } (x,y) \text{ of the stem outboard motor } 7=(xF,yF) \quad (1)$$

where xL=xR, and yL=−yR.

Figure 3:
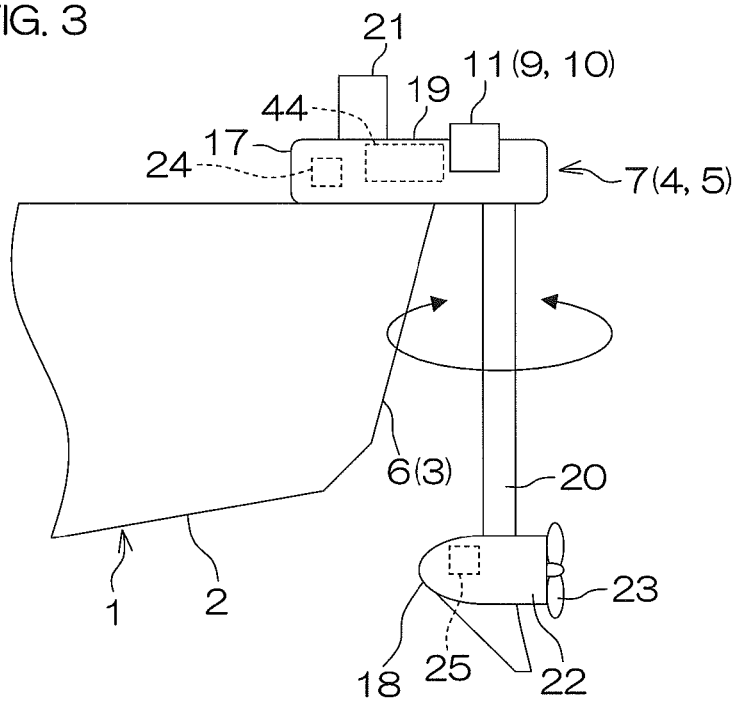
FIG. 3 is a schematic side view to describe a common construction of the respective outboard motors.

FIG. 3 is a schematic side view to describe a common construction of the outboard motors.

Each of the outboard motors 4, 5 and 7 (here, the stem outboard motor 7 is representatively shown) includes an electromotive steering apparatus 17 which functions as a steering mechanism, and a propeller system 18.

The electromotive steering apparatus 17 includes a casing 19 detachably fixed in the hull 2, a shaft 20 extending from the casing 19 toward the water surface, and a servomotor 21 provided in the casing 19 to turn the shaft 20 around the axis thereof. The electromotive steering apparatus 17 further includes a reduction mechanism 44 including gears, etc. The reduction mechanism 44 includes a reduction mechanism in which gears with different numbers of teeth are combined, a reduction mechanism in which a pulley and a belt are combined, or the like. In this preferred embodiment, the corresponding ECU (In FIG. 3, the stem ECU 11) is attached to the casing 19 and is electrically connected to the servomotor 21. The servomotor 21 is driven by being supplied with electric power from the above-mentioned battery 12 (refer to FIG. 1) via the ECU. The shaft 20 is preferably formed of steel, resin, or the like. The servomotor 21 is connected to the shaft 20 via the reduction mechanism 44. In addition, the casing 19 not only accommodates the above-mentioned components but also serves as an attaching device to mount the corresponding outboard motor at the hull 2.

The propeller system 18 includes a waterproof motor 22 and a propeller 23 directly connected to the rotation shaft of the motor 22. The motor 22 is integrally mounted to the water surface side end section of the shaft 20. The shaft 20 has a length such that the propeller system 18 can be disposed in water. The motor 22 is electrically connected to the ECU (in FIG. 3, the stem ECU 11) of the casing 19 via a cable (not illustrated) provided in the shaft 20. The ECU supplies power from the above-mentioned battery 12 (refer to FIG. 1) to the motor 22, and rotationally drives the motor 22. Since the propeller 23 is rotated as the motor 22 is rotationally driven, a propulsive force can be generated to move the hull 2.

The propeller system 18 has a rotational speed sensor 25 to detect an actual rotational speed of the motor 22. The rotational speed sensor 25 may include a pulse generation unit that generates a pulse synchronized with rotation of the motor 22. The ECU in the casing 19 detects pulse signals generated by the pulse generation unit, and calculates the rotational speed of the motor 22 based on the time interval between the pulse signals.

On the other hand, as the servomotor 21 is driven, power produced by the servomotor 21 is reduced and is transmitted to the shaft 20, whereby the shaft 20 and the propeller system 18 are pivoted around the axial line of the shaft 20 (refer to the arrows illustrated). Therefore, the steering angles (that is, the azimuth angle formed between the centerline 8 of the hull 2 and the direction of propulsive force) of the outboard motors 4, 5 and 7 can be changed. The electromotive steering apparatus 17 is provided with a steering angle sensor 24 using a potentiometer, etc., in order to detect an actual steering angle. The steering angle sensor 24 may be, for example, a sensor for outputting a signal that expresses the rotating angle of the shaft 20.

Figure 4:
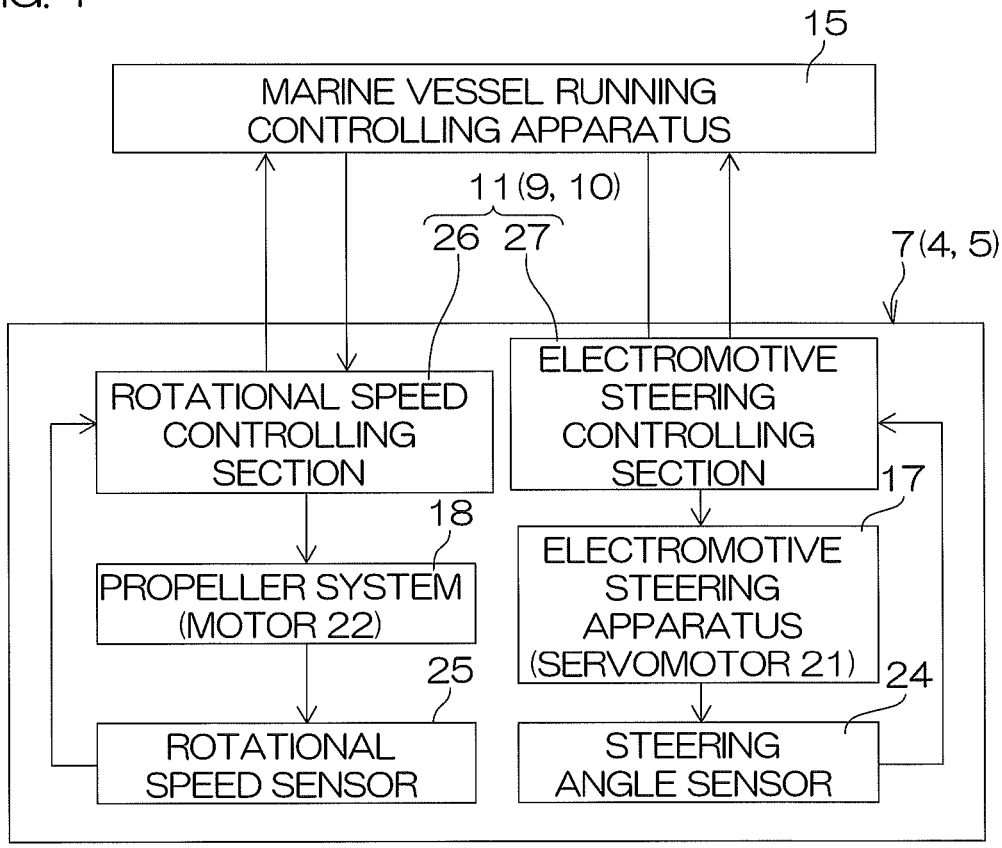
FIG. 4 is a block diagram to describe a command system and a response system between a marine vessel running controlling apparatus and the respective outboard motors.

FIG. 4 is a block diagram to describe a command system and a response system between the marine vessel running controlling apparatus 15 and the respective outboard motors 4, 5 and 7. Herein, a description is given of the construction corresponding to the stem outboard motor 7 shown in FIG. 3.

The ECU 11 corresponding to the outboard motor 7 includes a rotational speed controlling section 26 and an electromotive steering controlling section 27. The marine vessel running controlling apparatus 15 provides a target value of the propulsive force, which is to be generated by the motor 22 of the outboard motor 7, to the rotational speed controlling section 26, and provides a target value of the steering angle of the outboard motor 7 to the electromotive steering controlling section 27. The rotational speed controlling section 26 calculates a target rotational speed corresponding to the target value of the propulsive force and controls the motor 22 of the propeller system 18 such that the actual value of the rotational speed detected by the rotational speed sensor 25 is made equal to the target rotational speed.

On the other hand, the electromotive steering controlling section 27 controls the servomotor 21 of the electromotive steering apparatus 17 such that the steering angle detected by the steering angle sensor 24 is made equal to the target value of the steering angle.

The relationship between a propulsive force F generated by the propeller system 18 and the rotational speed n of the motor 22 is given by the following expressions (2) and (3). In this preferred embodiment, the rotational speed of the motor 22 is the same as that of the propeller 23.

$$F=\rho D^4 KT(J)n|n| \quad (2)$$

$$J=u/(nD) \quad (3)$$

In the expressions (2) and (3), ρ is the density (constant) of water, D is a diameter (constant) of the propeller 23, KT is a thrust coefficient, J is an advance ratio, and u is an actual value of the wake speed of the propeller 23. The actually measured wake speed u of the propeller 23 may be detected directly by a speed sensor (not illustrated) provided in the vicinity of the propeller 23 or may be calculated by multiplying an actual navigation speed of the marine vessel 1 by a predetermined coefficient. The thrust coefficient KT is in a fixed relationship with the advance ratio J, that is, the propeller wake speed u and the rotational speed n of the motor 22, and the thrust coefficient KT can be attained by a map showing the relationship.

The rotational speed controlling section 26 calculates the target rotational speed n of the motor 22 of the outboard motor 7 by substituting the target value F of a propulsive force supplied from the marine vessel running controlling apparatus 15 and the actual value u of the wake speed of the propeller 23 in the expressions (2) and (3).

Based on the respective target values of the rotational speed of the motor 22 and the steering angle, the rotational speed controlling section 26 and the electromotive steering controlling section 27 drive the motor 22 and the servomotor 21, respectively. The actual rotational speed of the motor 22 which is detected by the rotational speed sensor 25, and the actual steering angle detected by the steering angle sensor 24 are fed back to the rotational speed controlling section 26 and the electromotive steering controlling section 27, respectively, as the actual values. The actual value of the rotational speed of the motor 22 and the actual value of the steering angle are also fed back to the marine vessel running controlling apparatus 15 via the rotational speed controlling section 26 and the electromotive steering controlling section 27, respectively.

The rotational speed controlling section 26 and the electromotive steering controlling section 27 control drive of the motor 22 and the servomotor 21 based on the fed-back actual values of the rotational speed of the motor 22 and the steering angle such that the actual values are made equal to the target values.

Figure 5:
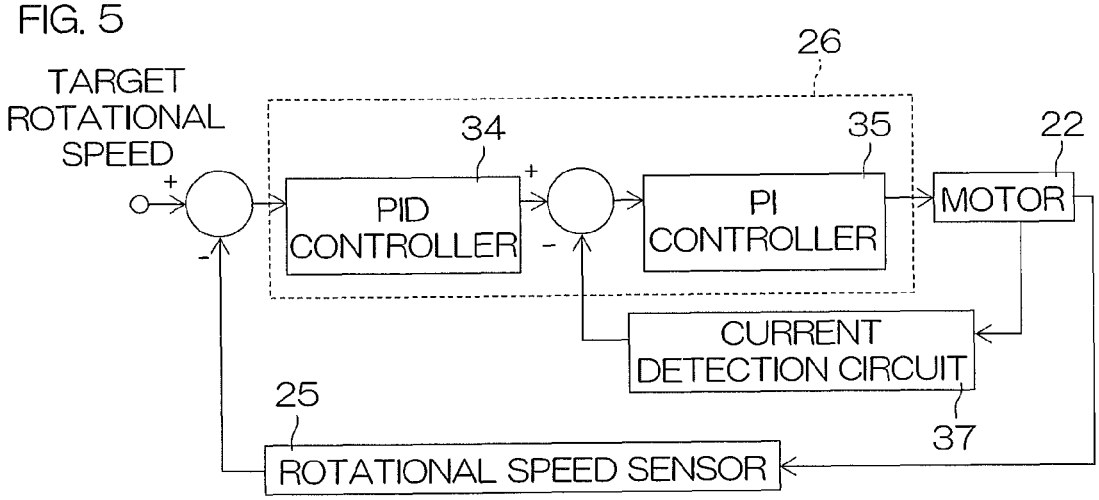
FIG. 5 is a block diagram to describe a flow of drive control of a motor in a rotational speed controlling section.

FIG. 5 is a block diagram to describe a flow of drive control of the motor 22 in the rotational speed controlling section 26. The rotational speed controlling section 26 includes a PID (proportional integral differential) controller 34 and a PI (proportional integral) controller 35. In addition, the outboard ECU 11 includes a drive circuit (not illustrated) for supplying a drive current to the motor 22 and a current detection circuit 37 for detecting the current supplied from the drive circuit to the motor 22.

Based on a deviation between the actual rotational speed of the motor 22 detected by the rotational speed sensor 25 and the target rotational speed thereof, the PID controller 34 outputs a target value of a current to be provided to the motor 22 in order to eliminate the deviation by using a proportional element, an integral element and a differential element (PID control). Based on a deviation between the output target value of current and the actual current value of the motor 22 detected by the current detection circuit 37, the PI controller 35 outputs a duty ratio to be applied to PWM (Pulse Width Modulation) control of the motor 22 in order to eliminate the deviation, by using the proportional element and the integral element (PI control). Then, the rotational speed of the motor 22 is detected by the rotational speed sensor 25, and the PID control and PI control are repeated such that this value, that is, the actual value of the rotational speed, is made equal to the target value. Hereinafter, the PID control and PI control carried out by the rotational speed controlling section 26 are collectively called "propulsive force control."

Figure 6:
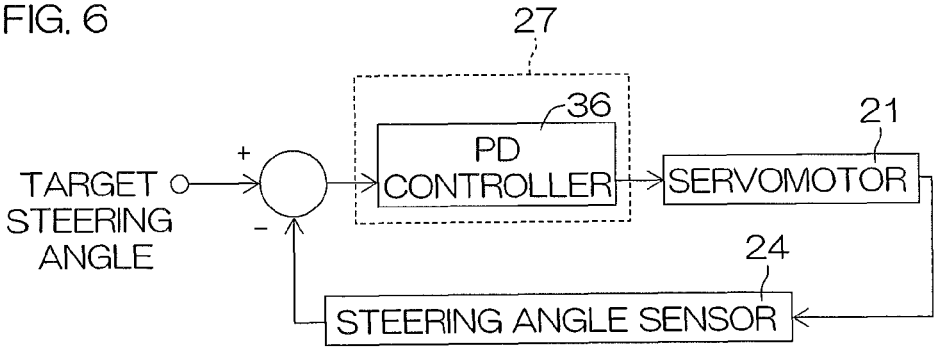
FIG. 6 is a block diagram to describe a flow of drive control of a servomotor in an electromotive steering controlling section.

FIG. 6 is a block diagram to describe a flow of drive control of the servomotor 21 in the electromotive steering controlling section 27. The electromotive steering controlling section 27 includes a PD (proportional differential) controller 36. Based on a deviation between an actual value of the steering angle detected by the steering angle sensor 24 and the target value, the PD controller 36 outputs a current to be provided to the servomotor 21 to eliminate the deviation, by using the proportional element and differential element (PD control). Then, the PD control is repeated such that the actual value of the steering angle detected by the steering angle sensor 24 is made equal to the target value. Hereinafter, the above-mentioned PD control carried out by the electromotive steering controlling section 27 is called "steering angle control."

Figure 7A:
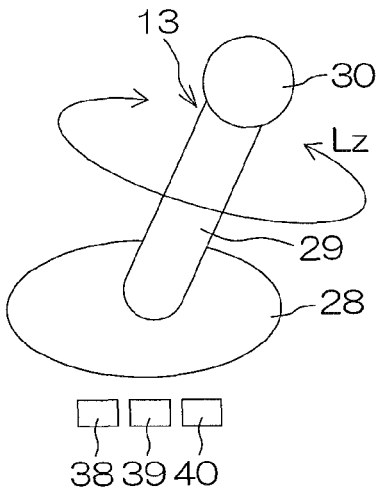
Figure 7B:
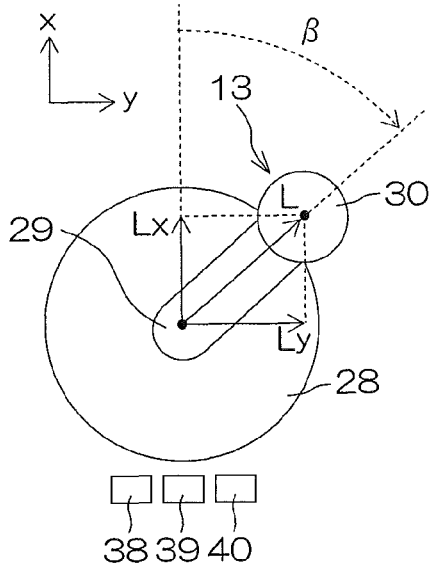

FIG. 7A and FIG. 7B are views to describe operation of the joystick 13. FIG. 7A is a perspective view of the inclined joystick 13, and FIG. 7B is a plan view obtained by projecting the joystick 13, which is in the state shown in FIG. 7A, onto the hull coordinate plane (that is, an x-y plane in the hull coordinate system).

As shown in FIG. 7A, the joystick 13 includes a rod 29 arranged to protrude in an inclined manner an operation panel 28 provided in the hull 2 to any desired direction, and a generally spherical knob 30 provided at a free end of the rod 29.

The neutral position of the rod 29 is a position that is erect with respect to the surface of the operation panel 28. An operator holds the knob 30 and inclines the rod 29 from the neutral position toward a desired direction to change the advancing direction of the marine vessel 1 in the direction corresponding to the inclination direction of the rod 29. The operator can control the propulsive force supplied from the outboard motors 4, 5 and 7 to the hull 2 based on the degree of inclination of the rod 29. That is, as the inclination of the rod 29 increase, the propulsive force applied to the hull 2 increases. Thereby, for example, if the rod 29 is greatly inclined to the stem side, the navigation speed of the marine vessel 1 is increased. On the other hand, if the rod 29 is inclined toward the stern side in a state where the marine vessel is advancing, the operator can carry out a braking operation by which the navigation speed is decreased, and further can move the marine vessel 1 backward.

Also, the knob 30 is made pivotable with respect to the rod 29 around the axis of the rod 29. The operator pivots the knob 30 around the axis of the rod 29, whereby the operator can turn (that is, turn around the instantaneous rotational center of the hull 2) the marine vessel 1. In particular, if the knob 30 is pivoted with the rod 29 as its neutral position in a state where the marine vessel 1 stops, the marine vessel 1 is caused to turn at a fixed point without changing the position of the marine vessel 1. The fixed point turning is carried out when mooring the marine vessel 1.

A pivot angle Lz (refer to the arrow in the drawing) of the knob 30 is detected by an angle sensor 38 provided in the operation panel 28. The marine vessel 1 is caused to turn (turn around) at an angular speed (yaw angle speed) corresponding to the pivot angle $L_z$.

On the other hand, an advance angle β (refer to FIG. 7B), which is an inclination direction angle of the rod 29, and the inclination angle (inclination amount) of the rod 29 are detected by a pair of position sensors 39 and 40 provided in the operation panel 28. As shown in FIG. 7B, taking a vector of a fixed size along the axial direction of the rod 29 into consideration, orthographic projection of the vector onto the x-y plane of the hull coordinate system is shown as L. A component (x component) $L_x$ along the x-axis direction (the direction parallel to the x-axis) of the orthographic projection vector L is detected by one position sensor 39. In addition, a component (y component) $L_y$ along the y-axis direction (the direction parallel to the y-axis) of the above-mentioned orthographic projection vector L is detected by the other position sensor 40. That is, the pair of position sensors 39 and 40 detect the amounts of inclination in the x-axis direction and the y-axis direction of the rod 29, respectively, and input the detection results into the marine vessel running control apparatus 15. The marine vessel running control apparatus 15 calculates propulsive forces $F_x$ and $F_y$ in the x-axis direction and the y-axis direction based on the x component $L_x$ and the y component $L_y$, and at the same time, calculates the advance angle β.

Figure 8:
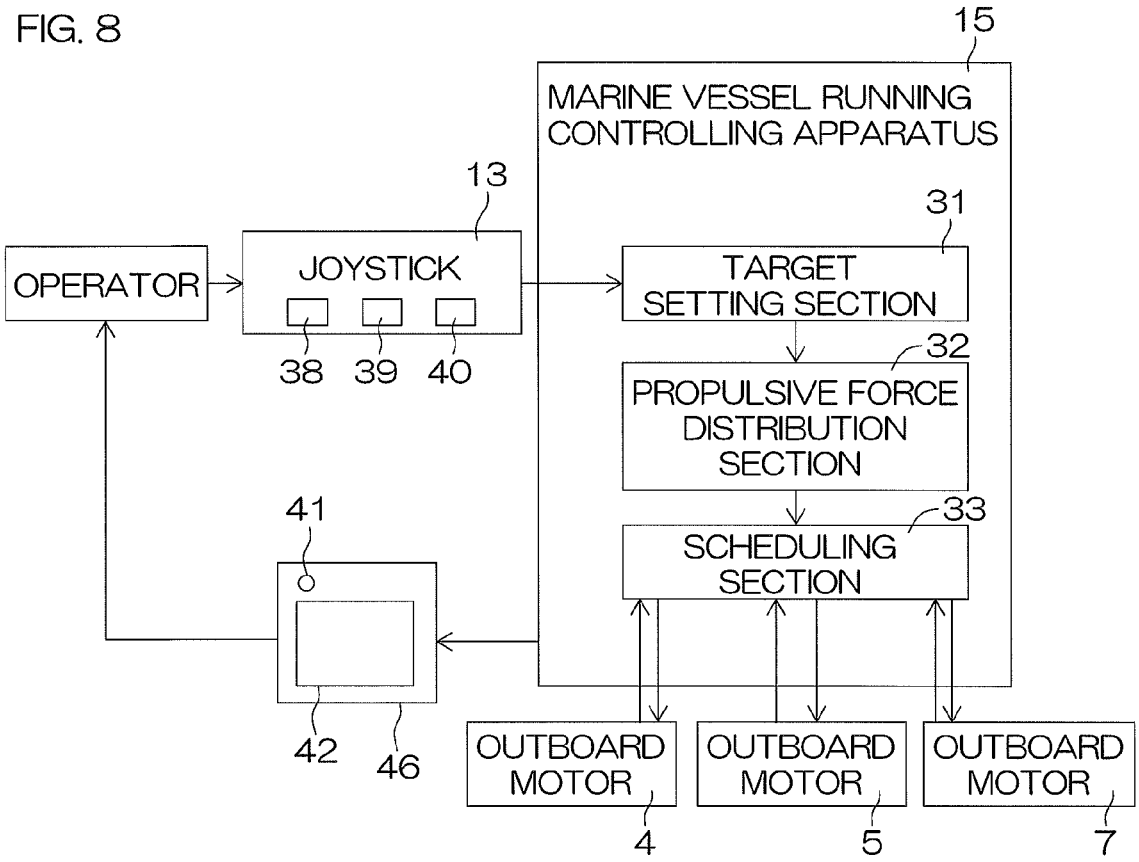
FIG. 8 is a block diagram to describe a control system of the respective outboard motors based on operations of the joystick.
Figure 9:
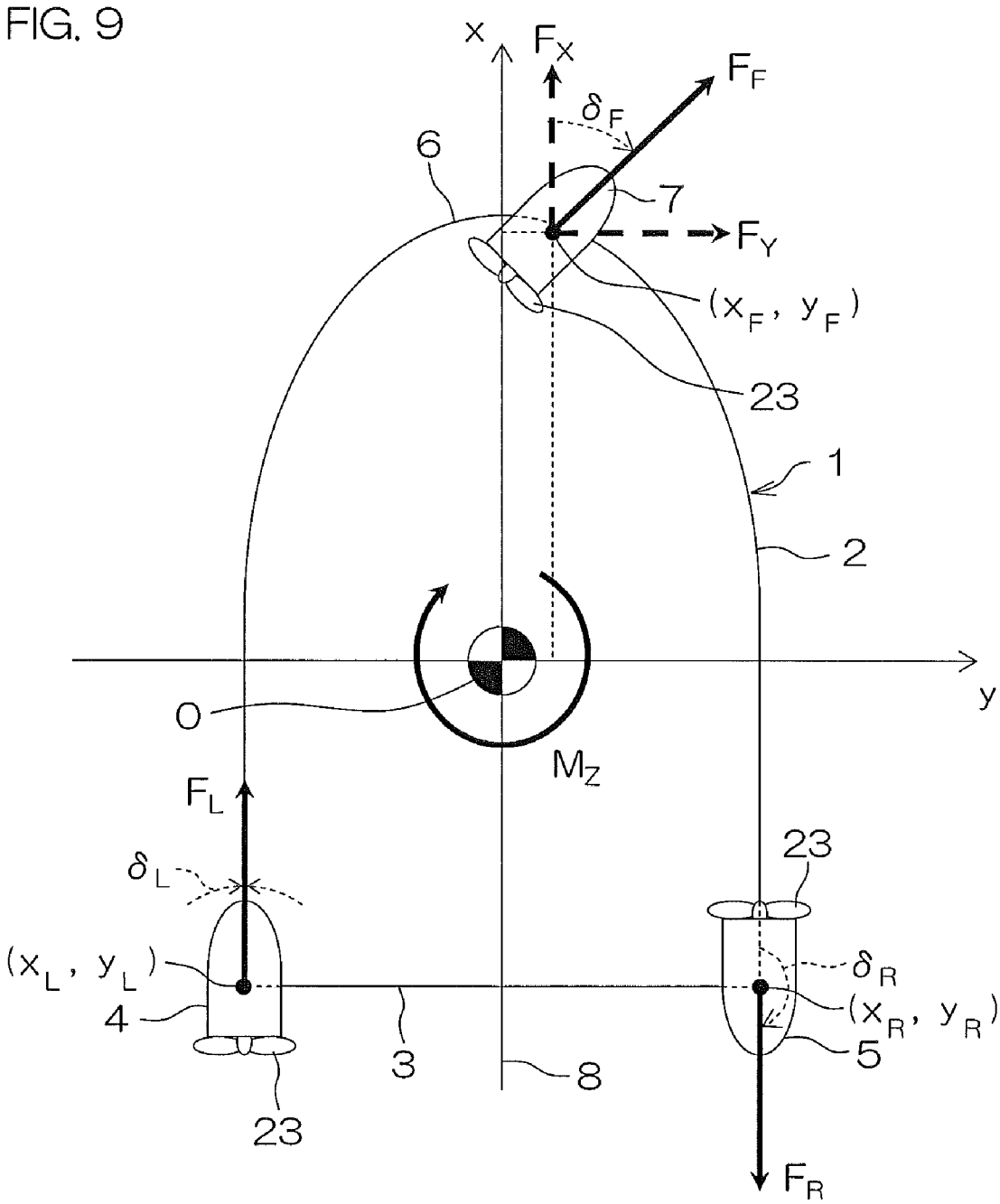
FIG. 9 is an illustrative view showing a state where predetermined target values of a propulsive force and a steering angle are reached in the respective outboard motors.

FIG. 8 is a block diagram to describe a control system of the outboard motors 4, 5 and 7 based on operation of the joystick 13. FIG. 9 is an illustrative view showing a state where predetermined target values of the propulsive force and the steering angle are reached in the respective outboard motors 4, 5 and 7.

The marine vessel running control apparatus 15 includes a target setting section 31, a propulsive force distribution section 32 serving as a target propulsive force setting unit, and a scheduling section 33 serving as a steering angle judging unit, a propeller system control unit, a threshold setting unit and a target propulsive force suppressing unit.

If an operator operates the joystick 13 and inclines the rod 29 in a desired direction, the x component Lx and the y component Ly, which are detected by the above-mentioned position sensors 39 and 40 are provided to the target setting section 31. Also, if the operator pivots the knob 30, the pivot angle Lz detected by the above-mentioned angle sensor 38 is provided to the target setting section 31.

The target setting section 31 sets a target propulsive force F and a target moment Mz to be acting on the hull 2 in order to achieve a ship behavior desired by the operator, based on the thus-provided x component Lx, y component Ly and pivot angle Lz.

The target setting section 31 calculates the x-axis direction component (forward/backward thrust) $F_x$ and the y-axis direction component (left/right thrust) $F_y$ of the target propulsive force (thrust) F by using the following expressions, based on the x component $L_x$ and the y component $L_y$ detected by the position sensors 39 and 40. Further, the target setting section 31 calculates the target moment $M_z$ based on the pivot angle $L_z$ detected by the angle sensor 38 by using the following expression.

$$F_x = c_x L_x$$

$$F_y = c_y L_y$$

$$M_z = c_z L_z \tag{4}$$

In the expression (4), cx, cy and cz are coefficients.

Also, the target setting section 31 sets the advance angle β (the azimuth angle with respect to the x-axis direction) showing the advancing direction of the marine vessel 1, which is desired by the operator, by using the following expression (5), based on the x component $L_x$ and the y component $L_y$ respectively detected by the position sensors 39 and 40.

$$\beta = \begin{cases} \tan^{-1}\dfrac{L_y}{L_x} & \text{if } L_x \geq \varepsilon \\ \mathrm{sgn}(L_y)\left(\pi - \tan^{-1}\left|\dfrac{L_y}{L_x}\right|\right) & \text{if } L_x \leq -\varepsilon \\ \mathrm{sgn}(L_y)\dfrac{\pi}{2} & \text{if } |L_x| < \varepsilon \text{ and } |L_x| \geq \varepsilon \\ 0 & \text{if } |L_x| < \varepsilon \text{ and } |L_x| < \varepsilon \end{cases} \tag{5}$$

In the expression (5), ϵ is a sufficiently small positive constant, sgn(Ly) is a sign function which becomes 1 when Ly is a positive number or 0, and which becomes −1 when Ly is a negative number.

The propulsive force distribution section 32 calculates target values of the propulsive force and steering angle to be distributed to the respective outboard motors 4, 5 and 7 by substituting a forward/backward thrust $F_x$, a left/right thrust Fy, the moment Mz, and the advance angle β, which are set by the target setting section 31, into the following expressions (6) through (11).

Target steering angle of stem outboard motor 7

$$\delta_F = \beta \tag{6}$$

Target steering angle of port-side outboard motor 4

$$\delta_L = \begin{cases} 0 & \text{if } M_z \geq 0 \\ \pi & \text{if otherwise} \end{cases} \tag{7}$$

Target steering angle of starboard-side outboard motor 5

$$\delta_R = \begin{cases} \pi & \text{if } M_z > 0 \\ 0 & \text{if otherwise} \end{cases} \tag{8}$$

Target propulsive force of stem outboard motor 7

$$F_F = \sqrt{F_x^2 + F_y^2} = \sqrt{(F_F\cos\delta_F)^2 + (F_F\sin\delta_F)^2} \tag{9}$$

Target propulsive force of port-side outboard motor 4

$$F_L = \frac{M_z - F_F(y_F\cos\delta_F + x_F\sin\delta_F)}{2y_L} \tag{10}$$

Target propulsive force of starboard-side outboard motor 5

$$F_R + F_L\frac{y_L}{y_R} \tag{11}$$

Since the above-mentioned moment $M_z$ is given by the following expression (12) as the total of moments acting on the entire hull 2, the expression (10) is derived by substituting the expressions (6), (9) and (11) into the expression (12).

$$M_z = F_x y_F + F_y x_F + F_L y_L + F_R y_R \tag{12}$$

In addition, as is clear from the expression (6), the advance angle β becomes the target steering angle $\delta_F$ of the stem outboard motor 7 as it is. Also, with respect to the respective target steering angles $\delta_L$ and $\delta_R$ of the port-side outboard motor 4 and the starboard-side outboard motor 5, either one is 0 or π, excluding a case of $M_z=0$. Where the respective coordinates of the port-side outboard motor 4 and the coordinates of the starboard-side outboard motor 5 are symmetrical to each other with the x-axis sandwiched therebetween (that is, $y_L=-y_R$), the respective target propulsive forces $F_L$ and $F_R$ of the port-side outboard motor 4 and the starboard-side outboard motor 5 are equal in size to each other with the directions thereof inverted. Therefore, a force-couple is produced between the port-side outboard motor 4 and the starboard-side outboard motor 5. This force-couple generates the moment $M_z$ which turns the marine vessel 1 around the instantaneous center. When the target moment $M_z$ is zero, $\delta_L=\delta_R=0$ is established, and the respective target propulsive forces $F_L$ and $F_R$ of the port-side outboard motor 4 and the starboard-side outboard motor 5 are parallel to each other with respect to their directions, and become equal to each other in size. Therefore, the moment acting on the hull 2 becomes zero. By inclining the rod 29 of the joystick 13 in this state, lateral movement maneuver is possible, by which parallel movement is carried out without turning the hull 2.

The target steering angles δF, δL, δR (called "target steering angle δ" collectively) and the target propulsive forces FF, FL and FR (called "target propulsive force F" collectively) of the respective outboard motors 4, 5 and 7, which are calculated by the expressions (6) through (11), are output into the scheduling section 33.

Figure 10:
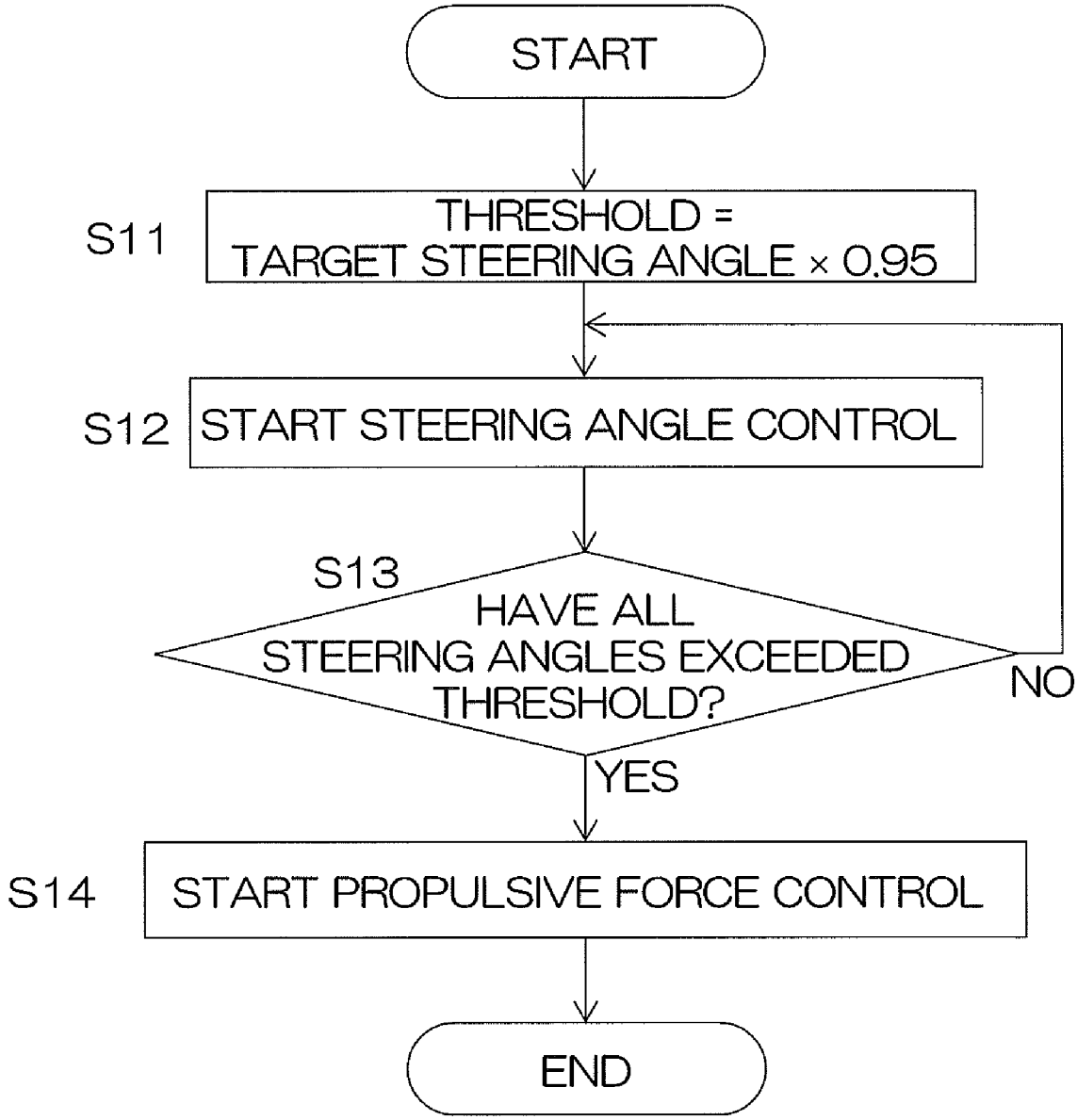
FIG. 10 is a flowchart to describe scheduling control carried out by a scheduling section.
Figure 11A:
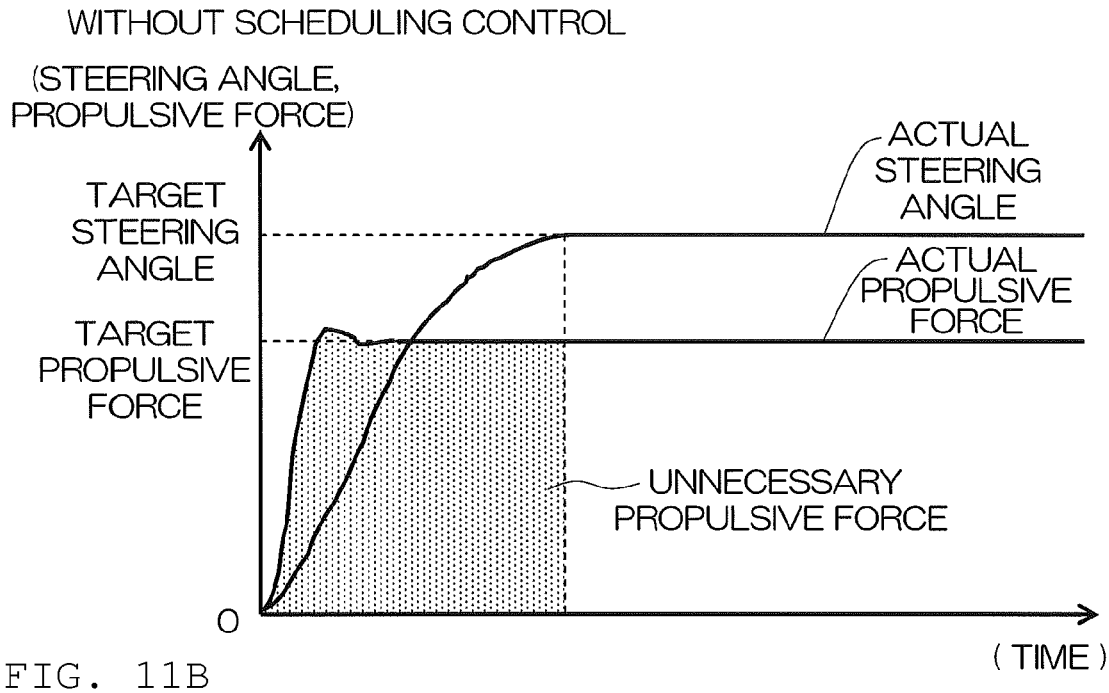
Figure 11B:
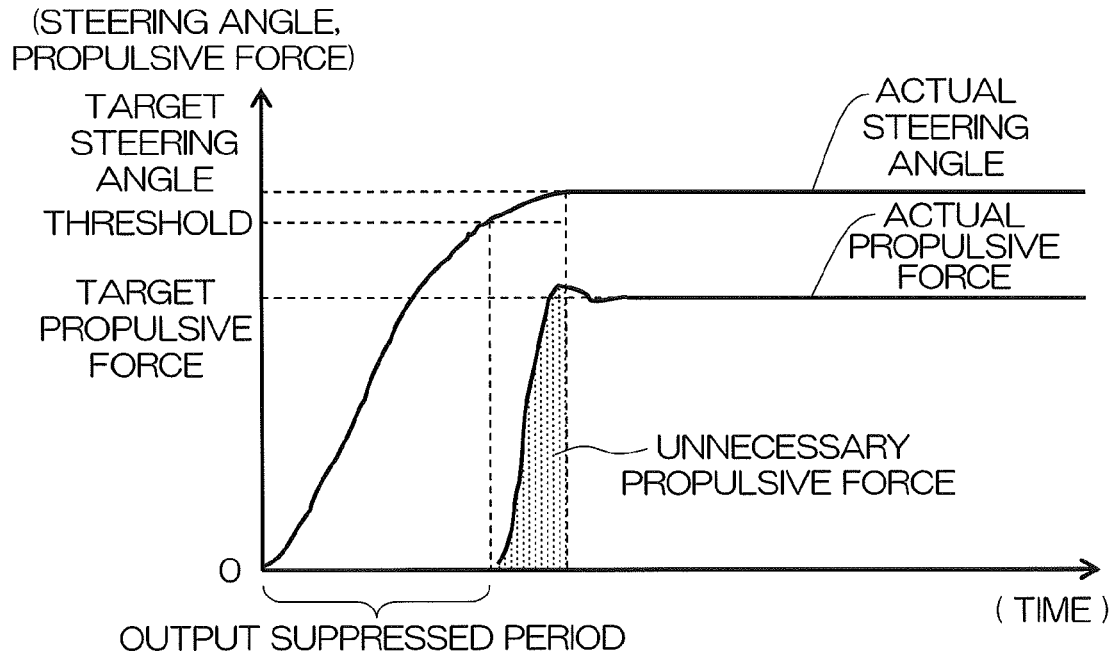
Figure 12B:
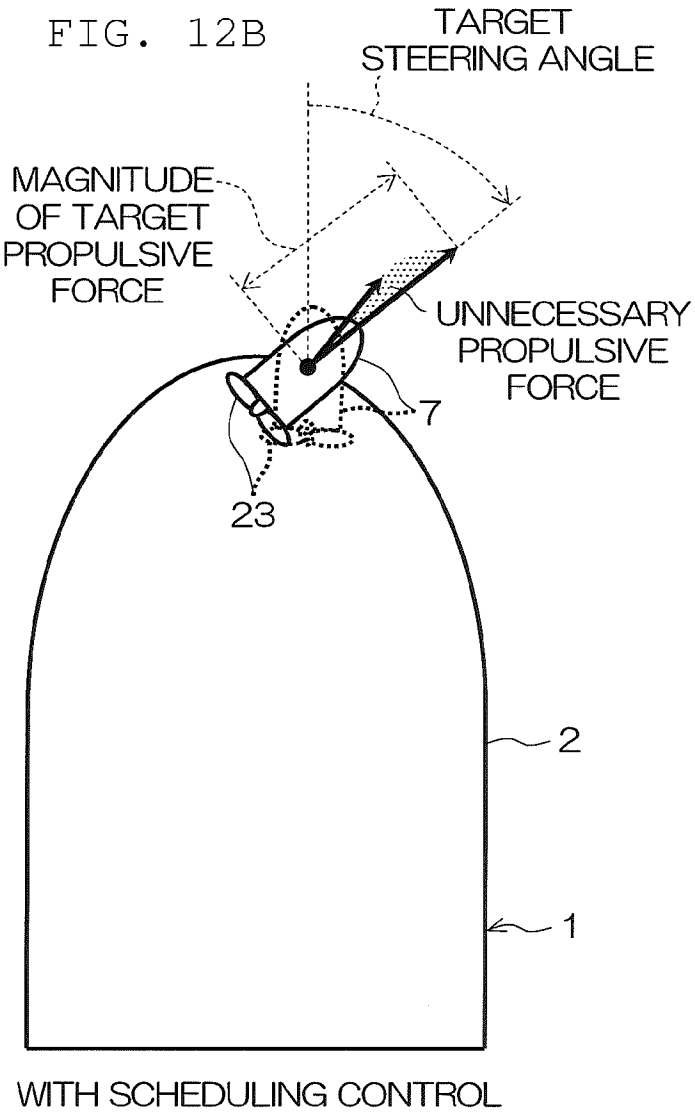
Figure 12A:
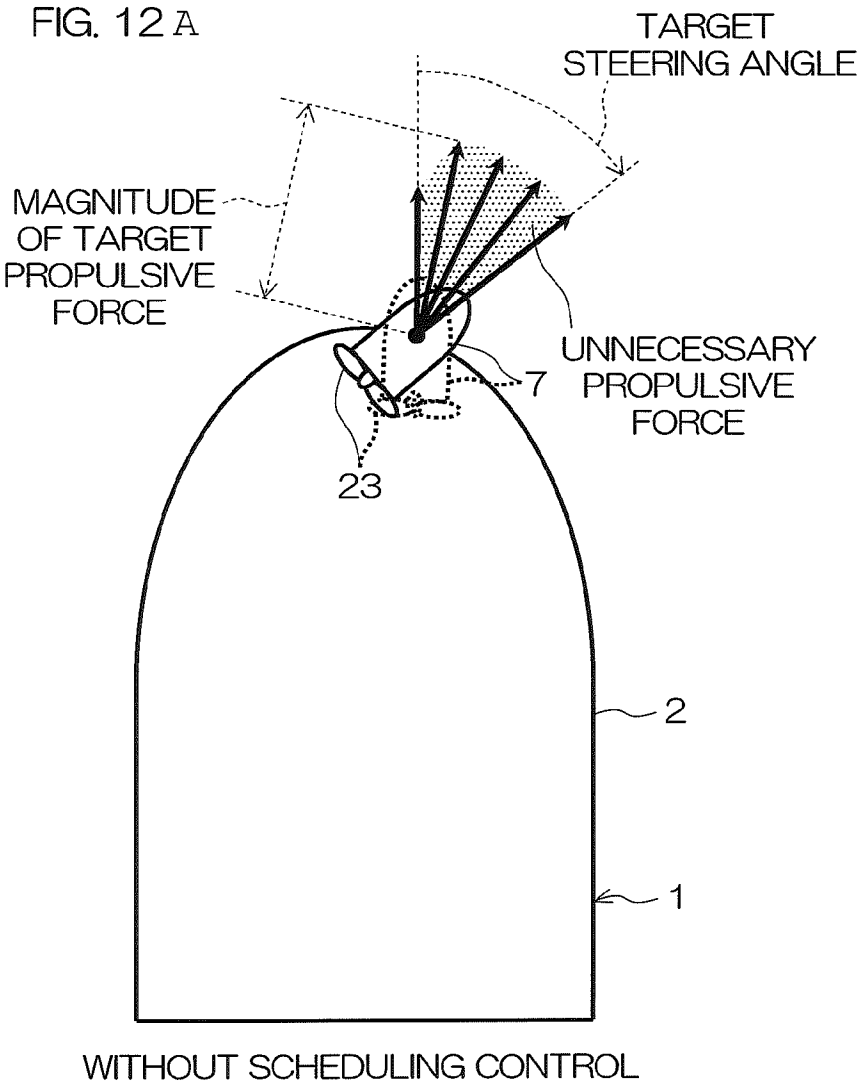

FIG. 10 is a flowchart to describe scheduling control carried out by the scheduling section 33. FIG. 11A and FIG. 11B are views showing, in chronological order, how the steering angle and the propulsive force of the outboard motor reach the respective target values δ and F. In detail, FIG. 11A shows a case where no scheduling control is carried out, and FIG. 11B shows a case where scheduling control is carried out, respectively. FIG. 12A and FIG. 12B are image views showing, by means of vectors with a predetermined interval, the propulsive force generated until the steering angle reaches a target value in the stem outboard motor 7. In detail, FIG. 12A shows a case where no scheduling control is carried out, and FIG. 12B shows a case where scheduling control is carried out, respectively. FIG. 13A and FIG. 13B are image views showing a movement locus of the marine vessel 1 until the steering angle reaches a target value in the stem outboard motor 7. In detail, FIG. 13A shows a case where no scheduling control is carried out, and FIG. 13B shows a case where scheduling control is carried out, respectively.

The scheduling section 33 carries out the scheduling control shown in FIG. 10 when the propulsive force distribution section 32 outputs target propulsive forces F and target steering angles δ of the respective outboard motors 4, 5 and 7. The details of the scheduling control are as follows, That is, the scheduling section 33 determines predetermined thresholds $TH_F$, $TH_L$ and $TH_R$ by multiplying target steering angles $\delta_F$, $\delta_L$, $\delta_R$ of the outboard motors 4, 5 and 7 by a predetermined ratio (for example, approximately 0.95 is used in the present preferred embodiment), respectively (Step S1). The predetermined ratio to determine the thresholds $TH_F$, $TH_L$ and $TH_R$ are determined in advance by performing an operation test.

As the thresholds THF, THL and THR regarding the steering angles are determined (Step S11), the scheduling section 33 outputs the target steering angles δF, δL, δR to the respective electromotive steering controlling sections 27 of the corresponding outboard motors 4, 5 and 7. In response thereto, the electromotive steering controlling section 27 starts the steering angle control based on the corresponding target steering angle δ (Step S12).

During the steering angle control, an actual steering angle detected by the steering angle sensor 24 of each of the outboard motors 4, 5 and 7 is fed back to the marine vessel running controlling apparatus 15 as described above, and the scheduling section 33 monitors the fed-back actual steering angle in real time.

When the actual steering angles in all the outboard motors 4, 5 and 7 exceed the respective thresholds $TH_F$, $TH_L$, $TH_R$ (YES at Step S13), the scheduling section 33 outputs respective target propulsive forces $F_F$, $F_L$ and $F_R$ to the rotational speed controlling sections 26 of the corresponding outboard motors 4, 5 and 7. In response thereto, the rotational speed controlling section 26 starts the propulsive force control by which output of the propeller system 18 is set such that a given target propulsive force F can be attained (Step S14). In other words, the scheduling section 33 suppresses the output of the propeller system 18 in each of the outboard motors 4, 5 and 7 to zero, that is, lower than the target propulsive force, while the steering angle is changed, that is, in this preferred embodiment, during the period from start of changing of the steering angle to reaching to the threshold (the period is referred to as an output suppressed period, refer to FIG. 11B). Suppressing of the output of the propeller system 18 may be carried out for the entire period during which the steering angle is changed, or may be carried out only for a portion of the period as in the present preferred embodiment.

On the other hand, if the actual steering angle of any one of the outboard motors 4, 5 and 7 is the above-mentioned threshold or less (NO at Step S13), the scheduling section 33 continuously monitors the respective actual steering angles of the outboard motors 4, 5 and 7.

Also, the marine vessel running controlling apparatus 15 causes an indicator (not illustrated), etc., to display a message, for example, "propeller in standby" during the period until the propulsive force control is started in Step S14. Accordingly, it is possible to notify an operator of that drive of the motor 22 is delayed by the scheduling control. Thus, the operator can understand the operating state of the marine vessel 1 without any misunderstanding, whereby it is possible to prevent the operator from worrying about delay in generation of propulsive force.

If the above-mentioned scheduling control is not carried out, the target steering angle δ and the target propulsive force F are simultaneously output to the electromotive steering controlling section 27 and the rotational speed controlling section 26, respectively. As a result, as shown in FIG. 11A, the steering angle control and the propulsive force control are started at the same time. In the steering angle control, the steering angle is gradually approached to the target value δ by the electromotive steering apparatus 17 having the reduction mechanism 44. On the other hand, the propulsive force of the propeller system 18 will reach the target propulsive force at once much earlier than the timing at which the steering angle reaches the target value δ. Accordingly, as shown with the dotted areas in FIG. 11A and FIG. 12A, before the steering angle reaches the target value, an unnecessary propulsive force will act on the hull 2, whereby a desired ship behavior may not be achieved. In further detail, as shown in FIG. 12A, in comparatively early timing since a pivot of the outboard motor (here, the stem outboard motor 7 is illustrated as an example) is started in the direction shown by the broken line arrow, it is found that the target propulsive force is already generated. Therefore, there is a possibility that the marine vessel 1 begins to move in a direction different from the direction intended by the operator.

More specifically, as shown in FIG. 13A and FIG. 13B, it is assumed that, for example, when the steering angle of the stem outboard motor 7 is 90°, the position of the marine vessel 1 is an initial position A. Then, it is assumed that the steering angle of the stem outboard motor 7 is changed to 0° while the marine vessel 1 is caused to advance from the initial position A by operating the joystick 13. Further, it is assumed that the operator of the joystick 13 wants the marine vessel 1 to straightly advance along a target locus Y from the initial position A to X which is a target portion when the steering angle reaches 0°. In the thick solid line in the drawing, the length thereof indicates the amount of the propulsive force generated by the stem outboard motor 7, and the direction thereof indicates the direction of the propulsive force.

Where no scheduling control is carried out, as shown in FIG. 13A, the propulsive force rises immediately after pivoting of the stem outboard motor 7 is started at the initial position A, and the propulsive force quickly reaches the target propulsive force. That is, since the target propulsive force is generated at the stem outboard motor 7 from the state where the steering angle of the stem outboard motor 7 is near 90°, the marine vessel 1 advances out of the target locus Y (refer to a position B). Since the target propulsive force is generated much earlier than the timing when the steering angle of the stem outboard motor 7 reaches 0° (target steering angle), the marine vessel 1 advances further out of the target locus Y (refer to a position C). Even, thereafter, the marine vessel 1 advances still further out of the target locus Y until the steering angle of the stem outboard motor 7 reaches 0° (refer to positions D and E). Accordingly, the operator is required to excessively operate the joystick 13 in order to return the marine vessel 1 from the position E to the target position X (refer to the one-dashed chain line arrow in the drawing).

On the contrary, if the scheduling control is carried out, as shown in FIG. 11B, the timing of generation of the propulsive force of the propeller system 18 can be delayed with respect to the control start timing of the electromotive steering apparatus 17. Therefore, it is possible to prevent the propulsive force from reaching the target value much earlier than the steering angle does. In detail, it is possible to almost synchronize the timings when the steering angle and the propulsive force reach the respective target values. As a result, as shown in the dotted areas in FIG. 11B and FIG. 12B, since an unnecessary propulsive force acting on the hull 2 can be almost eliminated, the propulsive force can be generated in a direction intended by the operator, whereby a desired ship behavior can be achieved. In addition, where the scheduling control is carried out, as shown in FIG. 13B, the propulsive force begins being generated in the stem outboard motor 7 when the steering angle approaches the target value (here, 0°) (refer to the position B), and the target propulsive force is generated when the steering angle reaches the target value (refer to the position C). For this reason, in comparison with the case where no scheduling control is carried out (refer to FIG. 13A), the deviation of the marine vessel 1 from the target locus Y is small, and it is also possible to minimize the amount of correction (refer to the one-dashed chain line arrow in the drawing) from the position E to the target position X after the steering angle reaches the target value. Also, if the marine vessel 1 begins moving in a direction not intended by the operator, the operator begins steering so as to correct the movement. At this time, although the marine vessel 1 is subjected to an unstable behavior, with preferred embodiments of the present invention, such unstable behavior can be prevented from occurring.

In addition, in the scheduling control, as shown in Step S13 of FIG. 10, when the actual steering angles in all the outboard motors 4, 5 and 7 reach the respective thresholds $TH_F$, $TH_L$ and $TH_R$, the respective propeller systems 18 are caused to operate, whereby propulsive forces are generated. For this reason, it is possible to prevent the propulsive force of any one of the propeller systems 18 from reaching the target value much earlier than the steering angles of all the outboard motors 4, 5 and 7 reach the target value. That is, a desired propulsive force can be provided to the hull 2 almost simultaneously with the steering angles of all the outboard motors 4, 5 and 7 reaching the target values. Therefore, a ship behavior intended by the operator can be achieved. For example, at the time of the lateral movement maneuver, by which the hull 2 is subjected to parallel movement, without turning the hull 2 (that is, yaw angle speed=0), it is possible to suppress or prevent the hull 2 from unintended turning or from moving in an unintended direction.

Figure 14:
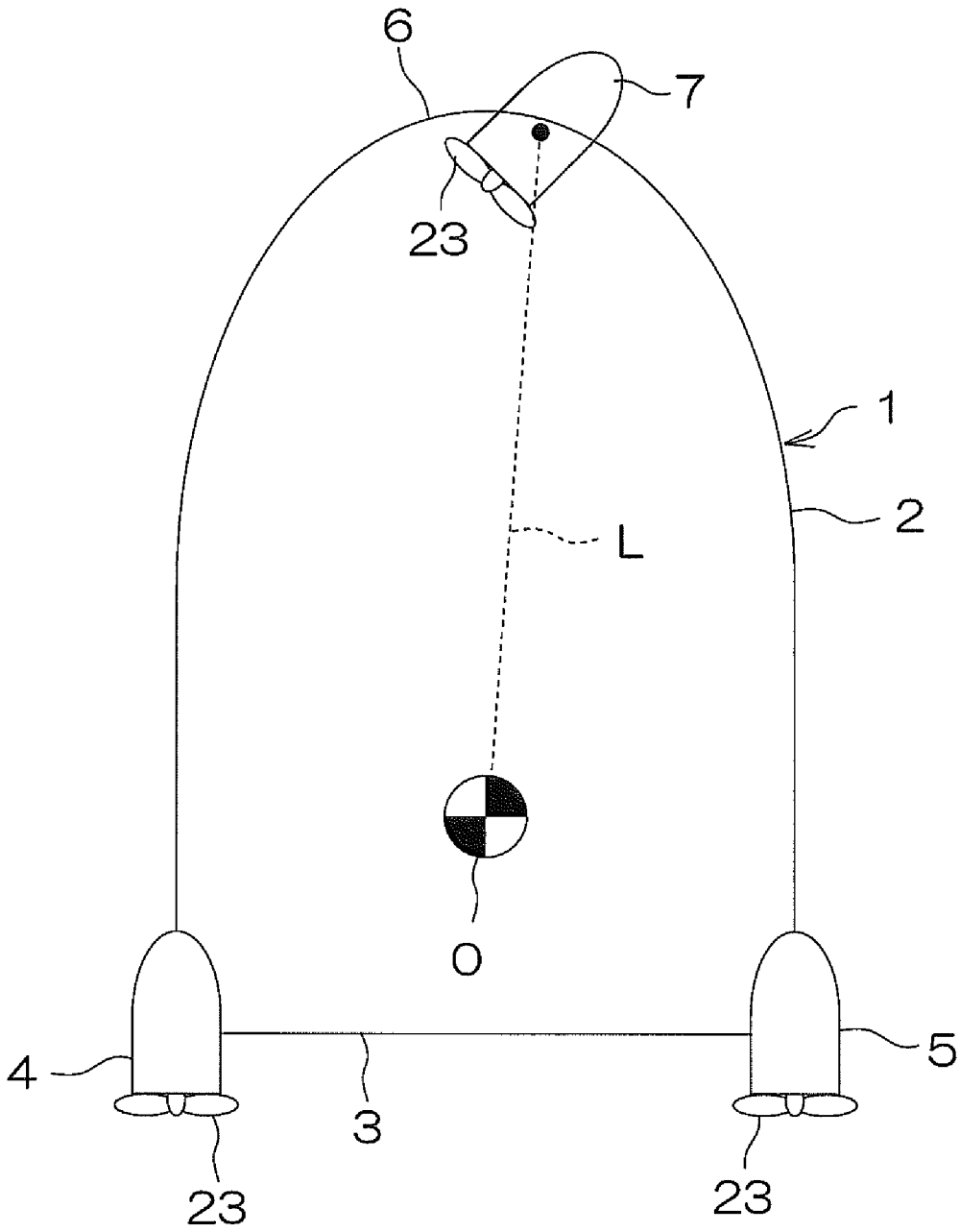
FIG. 14 is a conceptual view of the marine vessel to describe a positional relationship between the center of gravity of the marine vessel and the stem outboard motor.

Although it is preferable that the scheduling control is carried out for all the outboard motors 4, 5 and 7, it is necessary to carry out the scheduling control at least for the stem outboard motor 7. Referring to FIG. 14, in the stem outboard motor 7, the propeller system 18 preferably is generally small-sized, and therefore it is light in weight. On the other hand, since the outboard motors 4 and 5 provided at the stern 3 generally have preferably large-sized propeller systems 18, the center 0 of gravity of the hull 2 is displaced to the stern 3 side due to the weight of the outboard motors 4 and 5. Therefore, the distance L between the stem outboard motor 7 and the center 0 of gravity becomes comparatively long. Accordingly, the propulsive force produced by the stem outboard motor 7 provides the hull 2 with a large moment around the center 0 of gravity, and greatly influences the ship behavior. Therefore, if the scheduling control is carried out for the stem outboard motor 7, an unnecessary moment can be prevented, whereby a desired ship behavior can be realized.

The thresholds THF, THL and THR are determined by multiplying the target steering angle δ by a predetermined ratio as shown in Step S11 of FIG. 10, the thresholds can be automatically changed to adequate values when the target steering angle is changed. For this reason, the scheduling control adaptive to the target steering angle δ can be achieved, whereby it is possible to optimize the timing of generation of the propulsive force without depending on the value of the target steering angle δ.

Further, in this preferred embodiment, although the above-mentioned predetermined ratio is made constant preferably to be about 0.95, the ratio may be set to a larger figure in a range from about 0.85 through about 0.95 when the navigation speed is low, and it may be set to a smaller figure in the range when the navigation speed is high.

Also, separately from the above-mentioned method using a predetermined ratio, the value obtained by subtracting a predetermined angle (hereinafter called a "remaining angle") from the target steering angle may be determined to be the thresholds THF, THL and THR. That is, when the actual steering angle reaches the value obtained by subtracting the remaining angle from the target steering angle, the propulsive force control is started. Therefore, as the remaining angle is greater, the delay time becomes shorter in the timing of generation of the propulsive force of the propeller system 18 with respect to the control start timing of the electromotive steering apparatus 17. On the other hand, as the remaining angle is smaller, the delay time becomes longer in the timing of generation of the propulsive force of the propeller system 18 with respect to the control start timing of the electromotive steering apparatus 17. The remaining angle may be changed in accordance with the navigation speed of the marine vessel 1. For example, the remaining angle may be set to be smaller in a range from about 2° through about 10° when the navigation speed is low, and it may be set to be larger in the range when the navigation speed is high.

Figure 15:
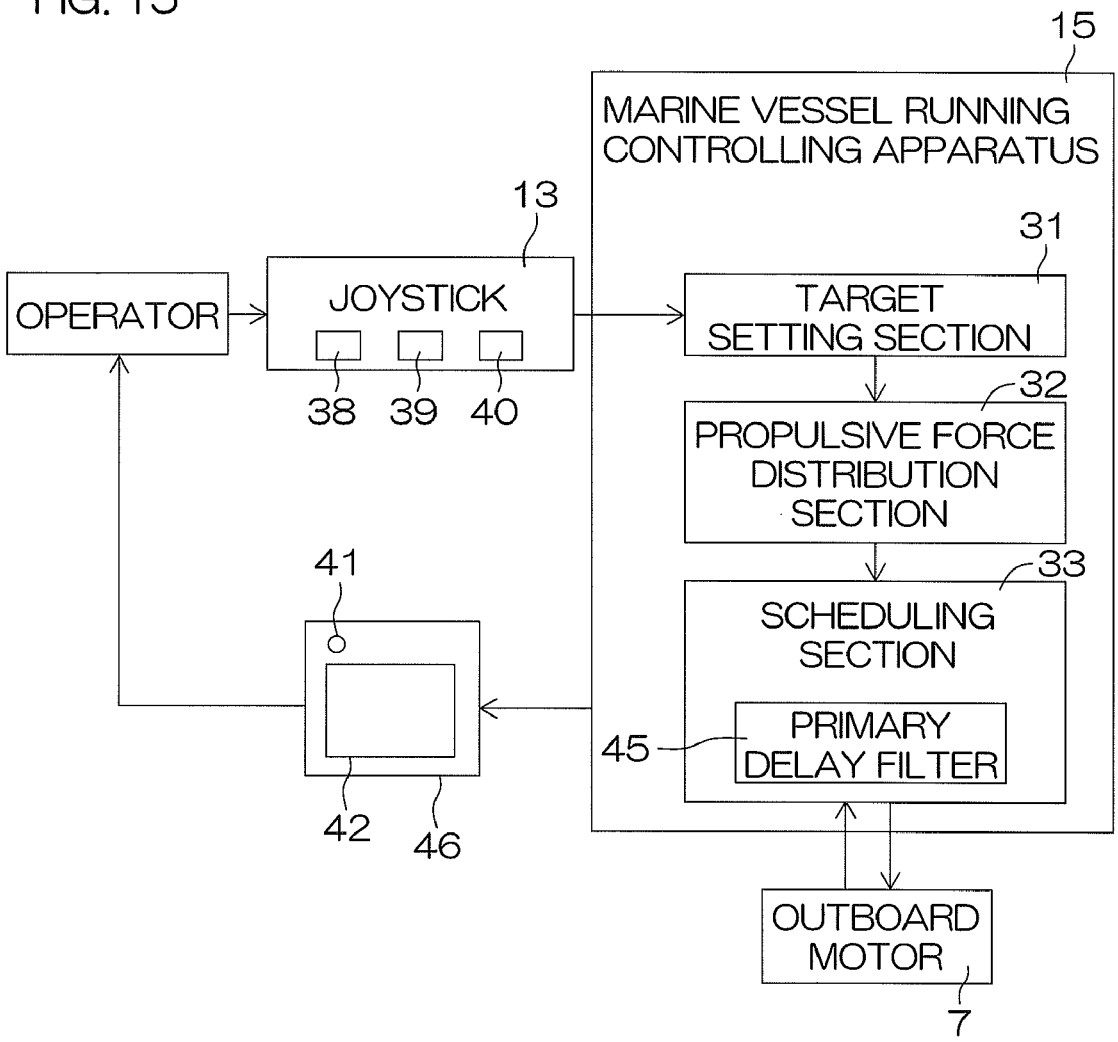
FIG. 15 is a block diagram to describe the control system of the stem outboard motor based on operation of the joystick.

Furthermore, another scheduling control different from the above-mentioned scheduling control may be performed for the stem outboard motor 7. FIG. 15 is a block diagram to describe the control system of the stem outboard motor 7 based on operation of the joystick 13. In FIG. 15, the same reference numerals are given to the above-mentioned elements, and description thereof is omitted.

Referring to FIG. 15, the scheduling section 33 includes a primary delay filter 45 as the target propulsive force control unit. The primary delay filter 45 is expressed by $1/(T \cdot s+1)$, where T is a time constant, and s is a Laplace operator. For example, the time constant T may be set to be equal to a time constant of the electromotive steering apparatus 17. The time constant of the electromotive steering apparatus 17 is the time until, for example, the actual steering angle reaches approximately 63% (approximately 63°) of a target steering angle of 100° when the target steering angle is stepwise supplied to the electromotive steering controlling section 27 in case that the current steering angle is 0°. If the time is 1 second, the time constant T can be set to 1.

The target propulsive force set by the propulsive force distribution section 32 is output into the rotational speed controlling section 26 (refer to FIG. 4) of the stem outboard motor 7, after passing through the primary delay filter 45 in the scheduling control.

Figure 16:
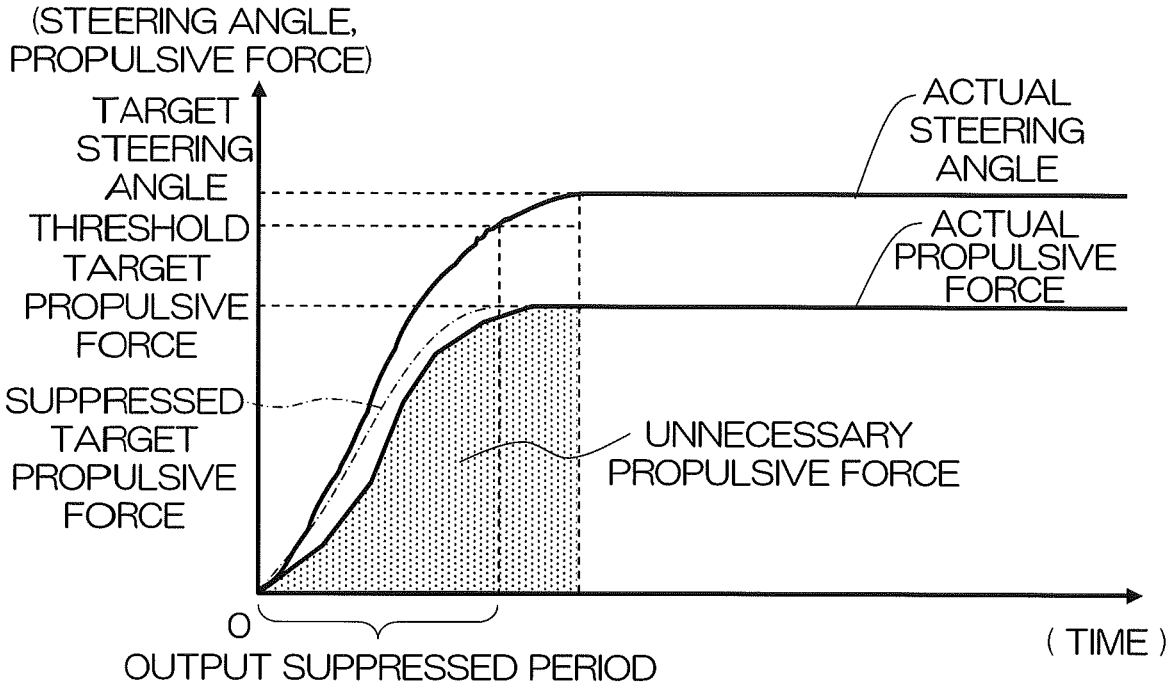
FIG. 16 is a view showing a case where another scheduling control is carried out in FIG. 11B.

In detail, as shown in FIG. 16, in the period during which the steering angle is changed, in further detail, in the period (output suppressed period) until, for example, the steering angle reaches the threshold immediately after a change in the steering angle is started, the target propulsive force is suppressed by passing through the primary delay filter 45 (refer to the one-dashed chain line in the drawing), and the propulsive force of the stem outboard motor 7 is controlled based on this suppressed target propulsive force. After the period (output suppressed period) is finished, the scheduling control is terminated, whereby the original target propulsive force set by the propulsive force distribution section 32 is directly output to the rotational speed controlling section 26 (refer to FIG. 4) of the stem outboard motor 7, without passing through the primary delay filter 45. That is, after the period (output suppressed period), suppressing of the target propulsive force is cancelled, and the propulsive force of the stem outboard motor 7 is controlled based on the original (not suppressed) target propulsive force.

Since the scheduling portion 33 carries out such scheduling control, the output (the actual propulsive force) of the stem outboard motor 7 is controlled such that the output becomes lower than the target propulsive force in the period (output suppressed period). For this reason, an unnecessary propulsive force acting on the hull 2 can be lowered in comparison with the case (refer to FIG. 11(*a*)) where no scheduling control is performed in the period (output suppressed period), whereby a desired ship behavior can be achieved.

Thus, the suppressed amount of the target propulsive force in the period (output suppressed period) decreases as the actual steering angle approaches the target value (target steering angle). That is, as the actual steering angle approaches the target steering angle, the suppressed target propulsive force may come near to the original target propulsive force set by the propulsive force distribution portion 32. Since an unnecessary moment generated by the propeller system 18 become smaller when the steering angle is near the target value, the propulsive force hardly influences the ship behavior. Rather, since the propulsive force approaches the target value as the steering angle approaches the target value, the ship behavior of marine vessel 1 is made quicker, and maneuverability thereof becomes excellent.

As shown in FIG. 8 and FIG. 15, the display section 46 is connected to the marine vessel running controlling apparatus 15. It is displayed on the display section 46 whether the scheduling control is carried out or not, whereby the operator is notified of this information. Thus, since the operator knows whether the scheduling control is carried out or not, a sense of discomfort of the operator can be reduced.

Figure 17B:
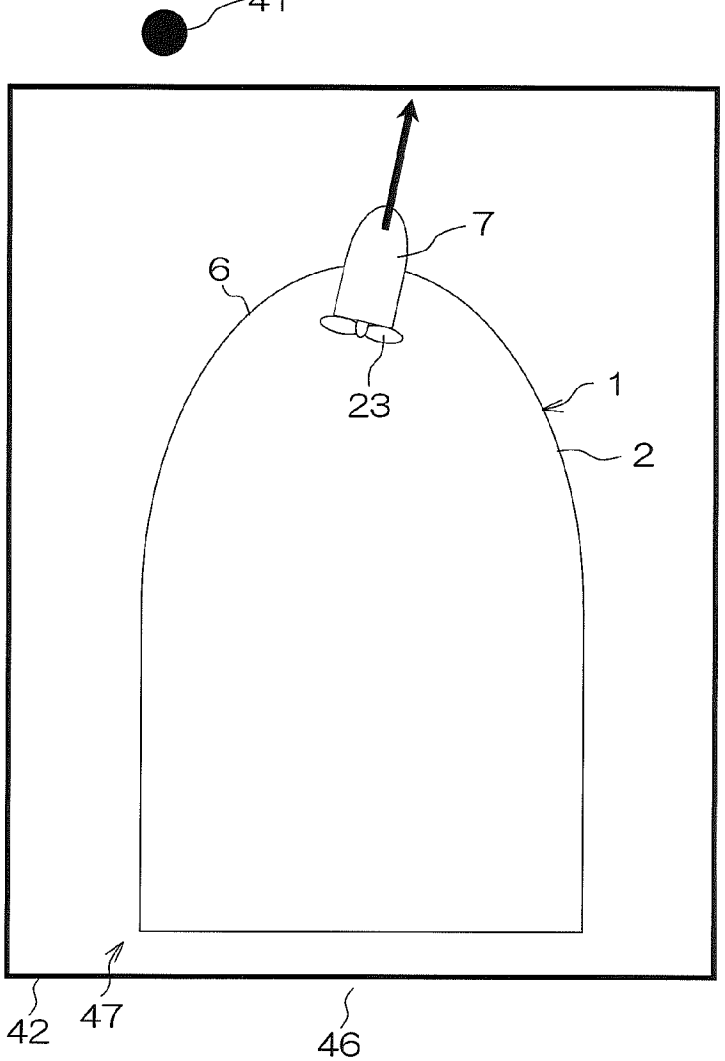
Figure 17A:
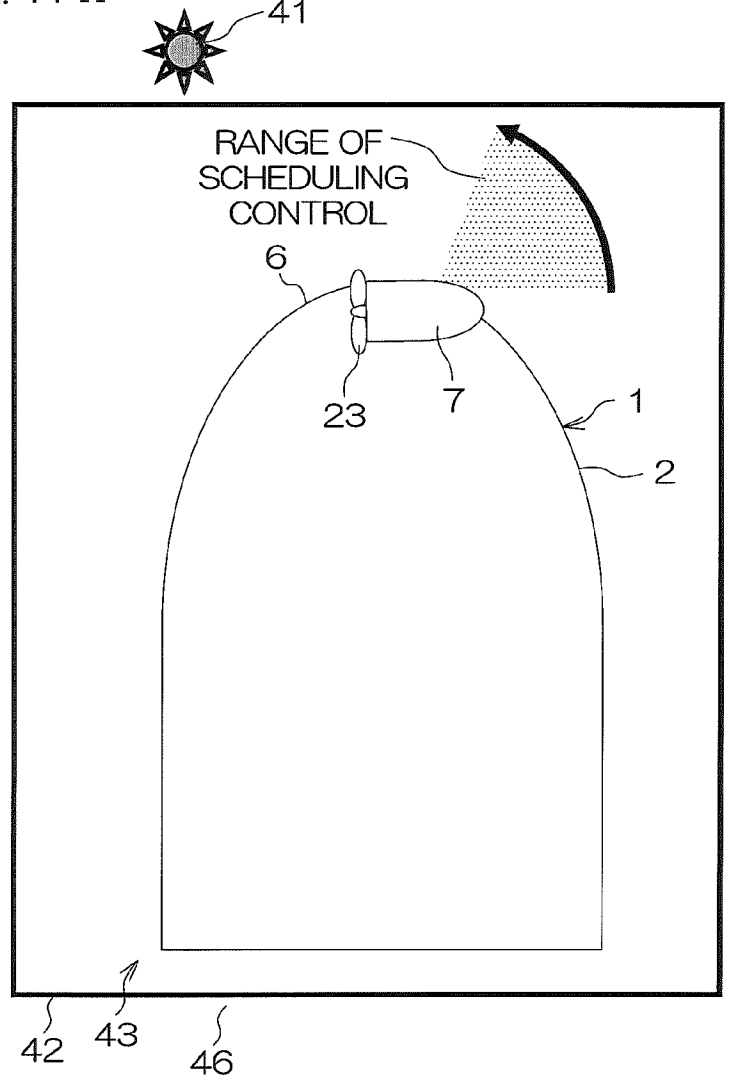

FIG. 17A and FIG. 17B are image views showing, in the display section 46, a state of notifying whether the scheduling control is carried out or not. In detail, FIG. 17A shows a state where it is notified that the scheduling control is in operation, and FIG. 17B shows a state where it is notified that the scheduling control is finished.

During the scheduling control, as shown in FIG. 17A, the indicator lamp 41 is turned on in the display section 46, and an image (called a first image 43) is displayed which shows that the scheduling control is in operation.

It is preferable that the indicator lamp 41 is a high brightness lamp. In this case, an operator can easily understand that the indicator lamp 41 is turned on without gazing at the display 46.

The first image 43 is a schematic plan view of the marine vessel 1, and shows a position of the stem outboard motor 7 (the position of the stem outboard motor 7 when the steering angle is 90°, in FIG. 17A) when the scheduling control is started (when change of the steering angle is started). Also, in the first image 43, a pivoting range (the range of scheduling control) of the stem outboard motor 7 from the start of the scheduling control to the termination thereof is displayed (refer to the arrow and the dotted area in the drawing). Here, with respect to the positions of the stem outboard motor 7, not only a position at the start of the scheduling control but also a changing position in the range of scheduling control may be stepwise or continuously displayed.

When the scheduling control is finished (when the steering angle reaches the above-mentioned threshold), as shown in FIG. 17B, the indicator lamp 41 is turned off. Also, the display of the screen 42 is changed from the first image 43 to an image (a second image 47) showing that the scheduling control is finished. The second image 47 is different from the first image 43 with respect to the surrounding of the stem outboard motor 7. In detail, in the second image 47, a position of the stem outboard motor 7 in which the steering angle is between the threshold and the target value is displayed. Further, the direction and magnitude of the propulsive force generated in the stem outboard motor 7 are schematically displayed by a solid arrow in the drawing.

As described above, since scheduling control is performed for at least the stem outboard motor 7, it is sufficient that the first image 43 and the second image 47 respectively show at least the stem outboard motor 7. However, the images 43 and 47 may also show the outboard motors 4 and 5 (refer to FIG. 14) on the stern 3 side. In addition, instead of turning on and off the indicator lamp 41, it may be notified to an operator by means of voice whether scheduling control is carried out or not.

Figure 18:
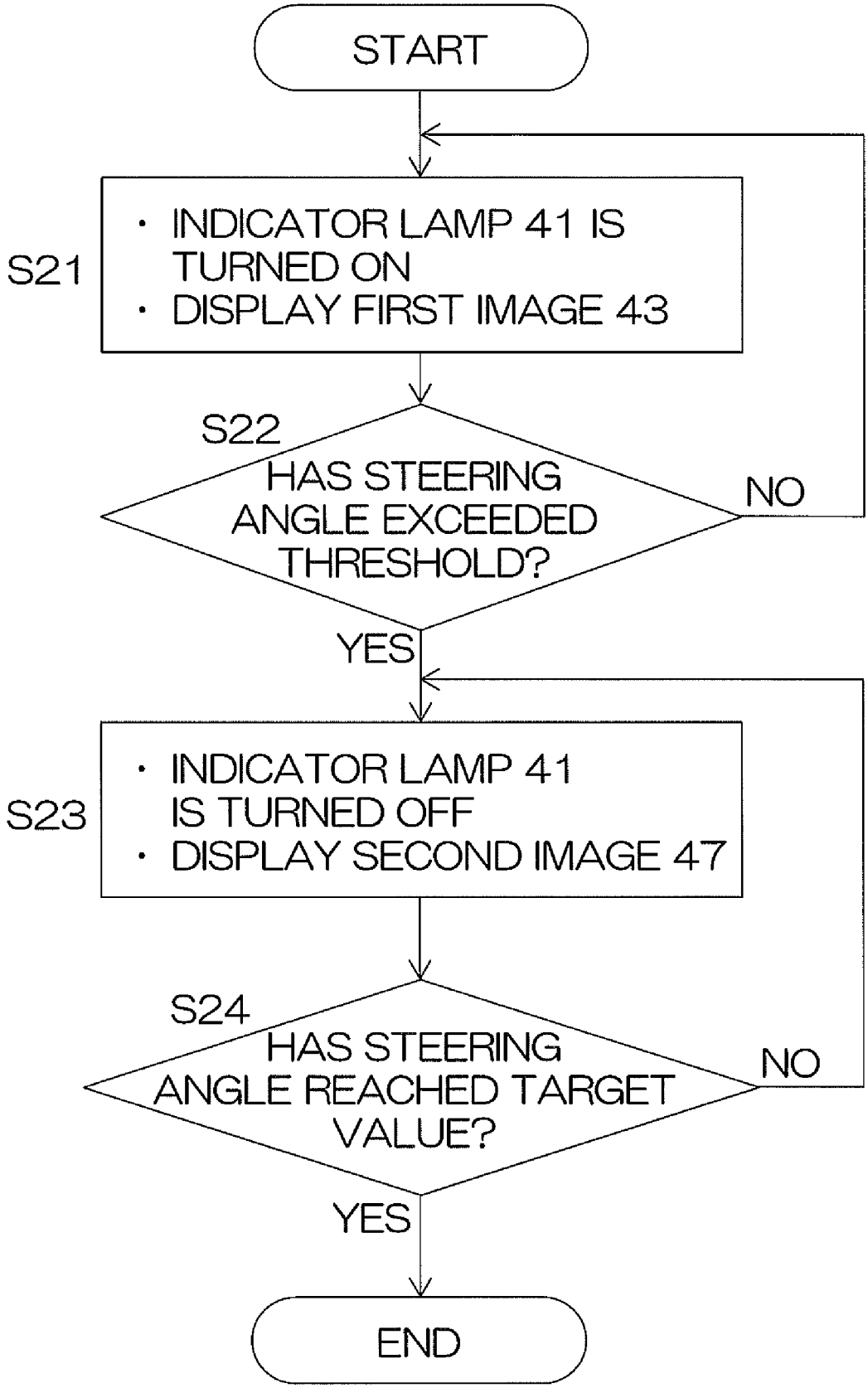
FIG. 18 is a flowchart to describe notification by the display section.

FIG. 18 is a flowchart to describe the notification by the display section 46. When the steering angle of the stem outboard motor 7 begins to change and the scheduling control is started by the scheduling section 33, the marine vessel running control apparatus 15 turns on the indicator lamp 41 and displays the first image 43 on the screen 42 (Step S21). It is thereby notified to the operator that the scheduling control is carried out. Then, as described above, when the steering angle of the stem outboard motor 7 reaches the threshold and the scheduling control is finished (YES at Step S22), the marine vessel running controlling apparatus 15 turns off the indicator lamp 41 and displays the second image 47 on the screen 42 (Step S23). It is thereby notified to the operator that the scheduling control is finished. Then, when the steering angle of the stem outboard motor 7 reaches the target value (YES at Step S24), the display of the second image 47 is finished. Thus, since nothing is displayed in the screen 42, the operator can understand that the actual steering angle and propulsive force of the stem outboard motor 7 have reached the respective target values (refer to FIG. 16).

In this preferred embodiment, when the steering angle reaches the threshold, the display of the screen 42 is changed from the first image 43 to the second image 47. However, the change of the images may be carried out when the target propulsive force which has been suppressed by passing through the primary delay filter 45 reaches the original target propulsive force or when the suppressed target propulsive force approaches the original target propulsive force (for example, when reaching 90% of the original target propulsive force).

The present invention is not limited to the preferred embodiments described above, but may be implemented in other preferred embodiments.

For example, the above-mentioned preferred embodiments show the construction in which three outboard motors preferably are provided. However, a construction with only one outboard motor or two outboard motors (for example, two outboard motors at the stern) may be used, or a construction with four or more outboard motors may be used.

Further, in the above-mentioned preferred embodiments, a description was given of the construction in which the propulsive forces and steering angles of electromotive outboard motors 4, 5 and 7 respectively provided with the electric motors 22 as motors are preferably controlled. However, the present invention is applicable to control of the propulsive force and steering angle of an outboard motor in which an engine is used as a motor. For example, where an engine provided with an electromotive throttle apparatus is used, it is possible to control the rotational speed of the engine by controlling the opening degree of the electromotive throttle, whereby the propulsive force can be controlled.

Still further, in the above-mentioned preferred embodiments, a description was given of the construction in which the outboard motors 4, 5 and 7 are controlled in response to operation of the joystick 13 by an operator. However, the present invention is applicable to automatic steering by which steering control of a marine vessel 1 is carried out without any operator. Examples of the automatic steering are fixed-point retention control, course control and locus control, etc. The fixed-point retention control is steering control by which a marine vessel is retained at a fixed position. The course control is steering control by which a marine vessel autonomously runs along a predetermined course, and the locus control is steering control by which a marine vessel autonomously runs along a predetermined locus. In such automatic steering, the marine vessel running control apparatus 15 automatically sets a target propulsive force and a target steering angle by predetermined program calculations. The outboard motors 4, 5 and 7 are controlled based on the target propulsive force and target steering angle which are thus automatically set.

In the above-mentioned preferred embodiments, the construction is used such that the steering angles of the outboard motors 4, 5 and 7 are changed preferably by driving the servomotors 21. However, hydraulic equipment may be used as a power source to change the steering angle.

Although detailed descriptions were given of the preferred embodiments according to the present invention, these are only specific examples used to describe the technical contents of the present invention, and the present invention is not to be interpreted as being restricted to the given preferred embodiments, and the spirit and the scope of the present invention are restricted only by the claims attached hereto.

The present application corresponds to Japanese Patent Application No. 2006-275108 filed with the Japan Patent Office on Oct. 6, 2006, and the entire disclosure of the application is incorporated herein by references.

What is claimed is:

1. A control apparatus for controlling a marine vessel propulsion system equipped with a propeller system to generate a propulsive force and a steering mechanism to change a steering angle of the propeller system, the control apparatus comprising:

a target steering angle setting unit arranged to set a target steering angle in accordance with an operation of an operation unit which is arranged to be operated by an operator;

a target propulsive force setting unit arranged to set a target propulsive force; and a propeller system control unit arranged to control an output of the propeller system such that an output thereof is lower than the target propulsive force while the steering angle is being changed during a period of time from when the steering angle starts changing to when a predetermined threshold of the steering angle is reached; wherein the control apparatus is connected to the operation unit and the marine vessel propulsion system through a network.

2. The control apparatus for controlling the marine vessel propulsion system according to claim 1, further comprising a steering angle judging unit arranged to judge whether the steering angle reaches the predetermined threshold or not, wherein, in response to the steering angle judging unit having judged that the steering angle has reached the threshold, the propeller system control unit sets the output of the propeller system such that the target propulsive force is attained.

3. The control apparatus for controlling the marine vessel propulsion system according to claim 2, wherein the control apparatus controls a plurality of the marine vessel propulsion systems, the steering angle judging unit is arranged to judge whether the steering angles of all the marine vessel propulsion systems reach the predetermined threshold or not, and in response to the steering angle judging unit having judged that the steering angles of all the marine vessel propulsion systems have reached the predetermined threshold, the propeller system control unit sets the outputs of the plurality of propeller systems such that the target propulsive force is attained.

4. The control apparatus for controlling the marine vessel propulsion system according to claim 2, wherein the control apparatus controls the steering mechanism based on the target steering angle set by the target steering angle setting unit, and further comprises a threshold setting unit arranged to determine the predetermined threshold by multiplying the target steering angle by a predetermined ratio.

5. The control apparatus for controlling the marine vessel propulsion system according to claim 1, wherein the propeller system control unit comprises a target propulsive force suppressing unit arranged to suppress the target propulsive force.

6. The control apparatus for controlling the marine vessel propulsion system according to claim 1, wherein the propeller system control unit decreases a suppressed amount of the target propulsive force as the steering angle approaches a target steering angle.

7. The control apparatus for controlling the marine vessel propulsion system according to claim 1, further comprising a notification unit arranged to provide an indication that the output of the propeller system is being controlled such that the output is lower than the target propulsive force.

8. The control apparatus for controlling the marine vessel propulsion system according to claim 1, wherein the marine vessel propulsion system comprises at least a propeller system provided at a stem portion of a marine vessel.

9. The control apparatus for controlling the marine vessel propulsion system according to claim 1, wherein the steering mechanism comprises a reduction mechanism arranged to reduce a drive force to change the steering angle.

10. A marine vessel running supporting system, comprising:

a marine vessel prolusion system comprising a propeller system to generate a propulsive force and a steering mechanism to determine a steering angle of the propeller system; and the control apparatus according to claim 1 to control the marine vessel propulsion system.

11. A marine vessel comprising:

a hull;

a marine vessel propulsion system which is attached to the hull, comprising a propeller system to generate a propulsive force and a steering mechanism to determine a steering angle of the propeller system; and the control apparatus for the marine vessel propulsion system according to claim 1.

12. The control apparatus for controlling the marine vessel propulsion system according to claim 1, wherein a delay occurs from the setting of the target steering angle by the target steering angle setting unit until the steering angle reaches the target steering angle, and the propeller system control unit controls the output of the propeller system to be lower than the target propulsive force within a period of the delay.

13. The control apparatus for controlling the marine vessel propulsion system according to claim 1, further comprising a threshold setting unit arranged to determine the predetermined threshold in accordance with the target steering angle set by the target steering angle setting unit.

14. The control apparatus for controlling the marine vessel propulsion system according to claim 1, further comprising a steering angle judging unit arranged to judge whether the steering angle reaches the predetermined threshold or not, wherein the propeller system control unit sets the output of the propeller system such that the output thereof is lower than the target propulsive force when the steering angle judging unit judges that the steering angle has not reached the threshold, and, in response to the steering angle judging unit having judged that the steering angle has reached the threshold, the propeller system control unit sets the output of the propeller system such that the target propulsive force is attained.

* * * * *